US006334937B1

(12) United States Patent
Batz, Jr. et al.

(10) Patent No.: US 6,334,937 B1
(45) **Date of Patent: *Jan. 1, 2002**

(54) APPARATUS FOR HIGH DEPOSITION RATE SOLDER ELECTROPLATING ON A MICROELECTRONIC WORKPIECE

(75) Inventors: Robert W. Batz, Jr., Kalispell; Scot Conrady, Anaconda; Thomas L. Ritzdorf, Bigfork, all of MT (US)

(73) Assignee: Semitool, Inc., Kalispell, MT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/386,213

(22) Filed: Aug. 31, 1999

Related U.S. Application Data

(63) Continuation of application No. PCT/US99/15850, filed on Jul. 12, 1999.
(60) Provisional application No. 60/114,450, filed on Dec. 31, 1998.

(51) Int. Cl.[7] ..... C25D 17/02
(52) U.S. Cl. ..... 204/212; 204/275.1; 204/277; 204/292; 204/297.01; 204/297.1; 204/224 R; 204/225
(58) Field of Search ..... 204/224 R, 212, 204/225, 275.1, 277, 292, 297.01, 297.1; 205/299–300

(56) References Cited

U.S. PATENT DOCUMENTS

| | | | |
|---|---|---|---|
| 3,716,462 | A | 2/1973 | Jensen |
| 3,878,066 | A | 4/1975 | Dettke et al. |
| 3,930,963 | A | 1/1976 | Polichette et al. |
| 4,137,867 | A | 2/1979 | Aigo |
| 4,246,088 | A | 1/1981 | Murphy et al. |
| 4,259,166 | A | 3/1981 | Whitehurst |
| 4,304,641 | A | 12/1981 | Grandia et al. |
| 4,341,629 | A | 7/1982 | Uhlinger |
| 4,422,915 | A | 12/1983 | Wielonski et al. |
| 4,466,864 | A | 8/1984 | Bacon |

(List continued on next page.)

FOREIGN PATENT DOCUMENTS

| | | |
|---|---|---|
| WO | WO00/32835 | of 0000 |
| WO | WO99/25904 | of 0000 |
| WO | WO99/25905 | 5/1999 |

* cited by examiner

*Primary Examiner*—Donald R. Valentine
(74) *Attorney, Agent, or Firm*—Christensen O'Connor Johnson Kindness PLLC

(57) ABSTRACT

The present invention is directed to an improved electroplating method, chemistry, and apparatus for selectively depositing tin/lead solder bumps and other structures at a high deposition rate pursuant to manufacturing a microelectronic device from a workpiece, such as a semiconductor wafer. An apparatus for plating solder on a microelectronic workpiece in accordance with one aspect of the present invention comprises a reactor chamber containing an electroplating solution having free ions of tin and lead for plating onto the workpiece. A chemical delivery system is used to deliver the electroplating solution to the reactor chamber at a high flow rate. A workpiece support is used that includes a contact assembly for providing electroplating power to a surface at a side of the workpiece that is to be plated. The contact contacts the workpiece at a large plurality of discrete contact points that isolated from exposure to the electroplating solution. An anode, preferably a consumable anode, is spaced from the workpiece support within the reaction chamber and is in contact with the electroplating solution. In accordance with one embodiment the electroplating solution comprises a concentration of a lead compound, a concentration of a tin compound, water and methane sulfonic acid.

18 Claims, 15 Drawing Sheets

U.S. PATENT DOCUMENTS 4,565,609 A 1/1986 Nobel et al.
4,565,610 A 1/1986 Nobel et al.
4,576,685 A 3/1986 Goffredo et al.
4,576,689 A 3/1986 Makkaey et al.
4,617,097 A 10/1986 Nobel et al.
4,685,414 A 8/1987 DiRico
4,849,059 A 7/1989 Deresh et al.
4,913,085 A 4/1990 Vöhringer et al.
4,959,278 A 9/1990 Shimauchi et al.
5,116,430 A 5/1992 Hirai et al.
5,135,636 A 8/1992 Yee et al.
5,209,817 A 5/1993 Ahmad et al.
5,227,041 A 7/1993 Brogden et al.
5,271,953 A 12/1993 Litteral
5,282,953 A 2/1994 Gernon et al.
5,296,128 A 3/1994 Gernon et al.
5,344,491 A 9/1994 Katou
5,372,848 A 12/1994 Blackwell et al.
5,391,285 A 2/1995 Lytle et al.
5,429,733 A 7/1995 Ishida
5,437,777 A * 8/1995 Kishi ..... 204/224 R
5,441,629 A 8/1995 Kosaki
5,443,707 A 8/1995 Mori
5,447,615 A 9/1995 Ishida
5,472,592 A 12/1995 Lowery et al.
5,549,808 A 8/1996 Farooq et al.
5,597,460 A 1/1997 Reynolds
5,597,836 A 1/1997 Hackler et al.
5,609,239 A 3/1997 Schlecker
5,639,316 A 6/1997 Cabral, Jr. et al.
5,651,873 A 7/1997 Uchiyama et al.
5,670,034 A 9/1997 Lowery
5,698,087 A 12/1997 Bokisa
5,744,019 A 4/1998 Ang
5,747,098 A 5/1998 Larson
5,776,327 A 7/1998 Botts et al.
5,788,829 A 8/1998 Joshi et al.
5,807,469 A 9/1998 Crafts et al.
5,843,296 A 12/1998 Greenspan
5,871,626 A * 2/1999 Crafts et al. ..... 204/297 R
5,904,827 A 5/1999 Reynolds
5,932,077 A 8/1999 Reynolds
6,001,235 A 12/1999 Arken et al.
6,017,437 A * 1/2000 Ting et al. ..... 204/224 R X
6,080,291 A 6/2000 Woodruff et al.

APPARATUS FOR HIGH DEPOSITION RATE SOLDER ELECTROPLATING ON A MICROELECTRONIC WORKPIECE

CROSS-REFERENCE TO RELATED APPLICATION

This is a continuation application of International PCT Patent Application No. PCT/US99/15850, designating the US, filed Jul. 12, 1999, entitled METHOD, CHEMISTRY, AND APPARATUS FOR HIGH DEPOSITION RATE SOLDER ELECTROPLATING ON A MICROELECTRONIC WORKPIECE, which claims priority from U.S. patent application Ser. No. 60/114,450, filed Dec. 31, 1998.

BACKGROUND OF THE INVENTION

Soldering has been a familiar technique for forming electrical and/or mechanical connections between metal surfaces and is the technique of choice for many applications in the electronics industry. Many soldering techniques have therefore been developed for applying solder to surfaces or interfaces between metals to extend soldering techniques to many diverse applications.

In the electronics industry, in particular, the trend toward smaller sizes of components and higher integration densities of integrated circuits has necessitated techniques for application of solder to extremely small areas and in carefully controlled volumes to avoid solder bridging between conductors.

High performance microelectronic devices often use solder balls or solder bumps for electrical interconnection to other microelectronic devices. For example, a very large scale integration (VLSI) chip may be electrically connected to a circuit board or other next level packaging substrate using solder balls or solder bumps. This connection technology is also referred to as "Controlled Collapse Chip Connection-C4" or "flip-chip" technology, and is often referred to as solder bumps.

In accordance with one type of solder bump technology developed by IBM, the solder bumps are formed by evaporation through openings in a shadow mask which is clamped to an integrated circuit wafer. For example, U.S. Pat. No. 5,234,149 entitled "Debondable Metallic Bonding Method" to Katz et al. discloses an electronic device with chip wiring terminals and metallization layers. The wiring terminals are typically primarily aluminum, and the metallization layers may include a titanium or chromium localized adhesive layer, a co-deposited localized chromium copper layer, a localized wettable copper layer, and a localized gold or tin capping layer. An evaporated localized lead-tin solder layer is located on the capping layer.

Solder bump technology based on an electroplating method has also been actively pursued. In this method, an "under bump metallurgy" (UBM) layer is deposited on a microelectronic substrate having contact pads thereon, typically by evaporation or sputtering. A continuous under bump metallurgy layer is typically provided on the pads and on the substrate between the pads, in order to allow current flow during solder plating.

An example of an electroplating method with an under bump metallurgy layer is disclosed in U.S. Pat. No. 5,162,257 entitled "Solder Bump Fabrication Method" to Yung. In this patent, the under bump metallurgy layer contains a chromium layer adjacent the substrate and pads, a top copper layer which acts as a solderable metal, and a phased chromium/copper layer between the chromium and copper layers. The base of the solder bump is preserved by converting the under bump metallurgy layer between the solder bump and contact pad into an intermetallic of the solder and the solderable component of the under bump metallurgy layer. Multiple etch cycles may, however, be needed to remove the phased chromium/copper layer and the bottom chromium layer. Even with multiple etch cycles, the under bump metallurgy layer may be difficult to remove completely, creating the risk of electrical shorts between solder bumps. U.S. Pat. No. 5,767,010, titled "Solder Bump Fabrication Methods and Structure Including a Titanium Barrier Layer", issued Jun. 16, 1998, purports to address this problem.

Several technical problems are typically associated with electroplating of tin/lead solder on semiconductor wafers and other microelectronic workpieces. One problem relates to the relatively low rate at which deposition of the solder takes place. Generally, the upper deposition rate for selectively depositing solder on the surface of a microelectronic workpiece is about 1 micron/minute. Attempts to significantly increase the deposition rate have heretofore proven unsuccessful. Most such attempts are hindered by the fact that a significant amount of gas evolves during the electroplating process, particularly when traditional inert anodes are employed. The resulting gas bubbles impair the proper formation of the solder bumps and other structures formed from the solder deposit. Additionally, removal of the evolved gases can be problematic. The microelectronic fabrication industry thus has been forced to accept low deposition rate solder processes and equipment.

Several technical problems must be overcome in designing reactors used in the electroplating of semiconductor wafers. Utilization of a small number of discrete electrical contacts (e.g., 6 contacts) with the seed layer about the perimeter of the wafer ordinarily produces higher current densities near the contact points than at other portions of the wafer. This non-uniform distribution of current across the wafer, in turn, causes non-uniform deposition of the plated solder material. Current thieving, effected by the provision of electrically-conductive elements other than those which contact the seed layer, can be employed near the wafer contacts to minimize such non-uniformiity. But such thieving techniques add to the complexity of electroplating equipment, and increase maintenance requirements.

Another problem with electroplating of wafers concerns efforts to prevent the electric contacts themselves from being plated during the electroplating process. Any solder plated to the electrical contacts must be removed to prevent changing contact performance. While it is possible to provide sealing mechanisms for discrete electrical contacts, such arrangements typically cover a significant area of the wafer surface, and can add complexity to the electrical contact design.

In addressing a further problem, it is sometimes desirable to prevent electroplating on the exposed barrier layer near the edge of the semiconductor wafer. Electroplated solder may not adhere well to the exposed barrier layer material, and is therefore prone to peeling off in subsequent wafer processing steps. Further, solder that is electroplated onto the barrier layer within the reactor may flake off during the electroplating process thereby adding particulate contaminants to the electroplating bath. Such contaminants can adversely affect the overall electroplating process.

The specific solder to be electroplated can also complicate the electroplating process. For example, electroplating of solder may require use of a seed layer having a relatively high electrical resistance. As a consequence, use of the typical plurality of electrical wafer contacts (for example, six. (6) discrete contacts) may not provide adequate uniformity of the plated metal layer on the wafer.

Beyond the contact related problems discussed above, there are also other problems associated with electroplating reactors for solder plating. As device sizes decrease, the need for tighter control over the processing environment increases. This includes control over the contaminants that affect the electroplating process. The moving components of the reactor, which tend to generate such contaminants, should therefore be subject to strict isolation requirements.

Still further, existing electroplating reactors are often difficult to maintain and/or reconfigure for different electroplating processes. Such difficulties must be overcome if an electroplating reactor design is to be accepted for large-scale manufacturing.

SUMMARY OF THE INVENTIONS

The present invention is accordingly directed to an improved electroplating method, chemistry, and apparatus for selectively depositing tin/lead solder bumps and other structures at a high deposition rate pursuant to manufacturing a microelectronic device from a workpiece, such as a semiconductor wafer. An apparatus for plating solder on a microelectronic workpiece in accordance with one aspect of the present invention comprises a reactor chamber containing an electroplating solution having free ions of tin and lead for plating onto the workpiece. A chemical delivery system is used to deliver the electroplating solution to the reactor chamber at a high flow rate. A workpiece support is used that includes a contact assembly for providing electroplating power to a surface at a side of the workpiece that is to be plated. The contact contacts the workpiece at a large plurality of discrete contact points that isolated from exposure to the electroplating solution. An anode, preferably a consumable anode, is spaced from the workpiece support within the reaction chamber and is in contact with the electroplating solution. In accordance with one embodiment the electroplating solution comprises a concentration of a lead compound, a concentration of a tin compound, water and methane sulfonic acid.

In accordance with one aspect of the present invention, the contact assembly comprises a plurality of contacts disposed to contact a peripheral edge of the surface of the workpiece. The plurality of contacts execute a wiping action against the surface of the workpiece as the workpiece is brought into engagement therewith. Further, the contact assembly includes a barrier disposed interior of the plurality of contacts that includes a member disposed to engage the surface of the workpiece to effectively isolate the plurality of contacts from the electroplating solution.

DETAILED DESCRIPTION OF THE INVENTIONS

BASIC SOLDER ELECTROPLATING REACTOR COMPONENTS

Figure 1:
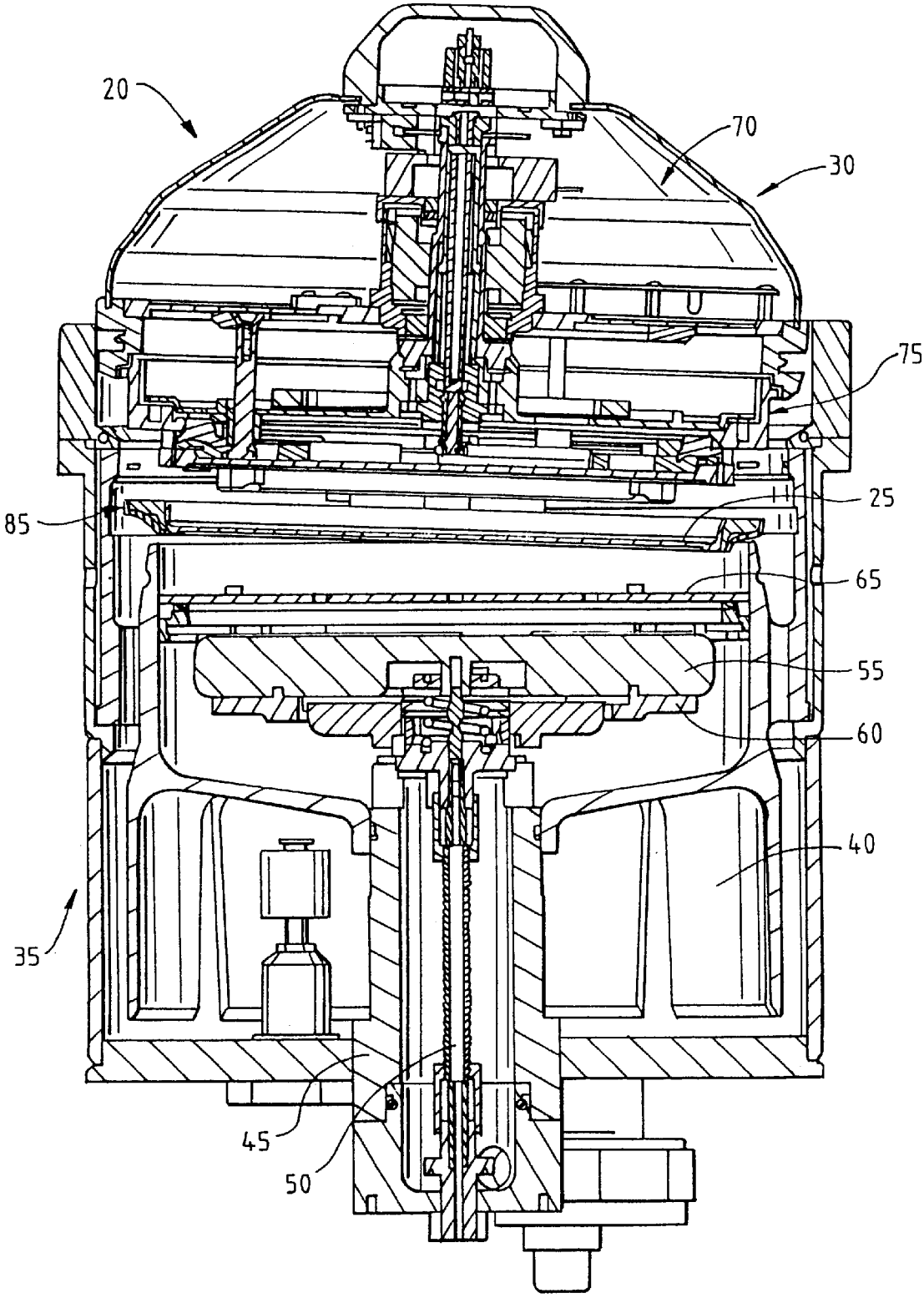
FIG. 1 is a cross-sectional view through an electroplating reactor that is constructed in accordance with various teachings of the present invention.
Figure 2:
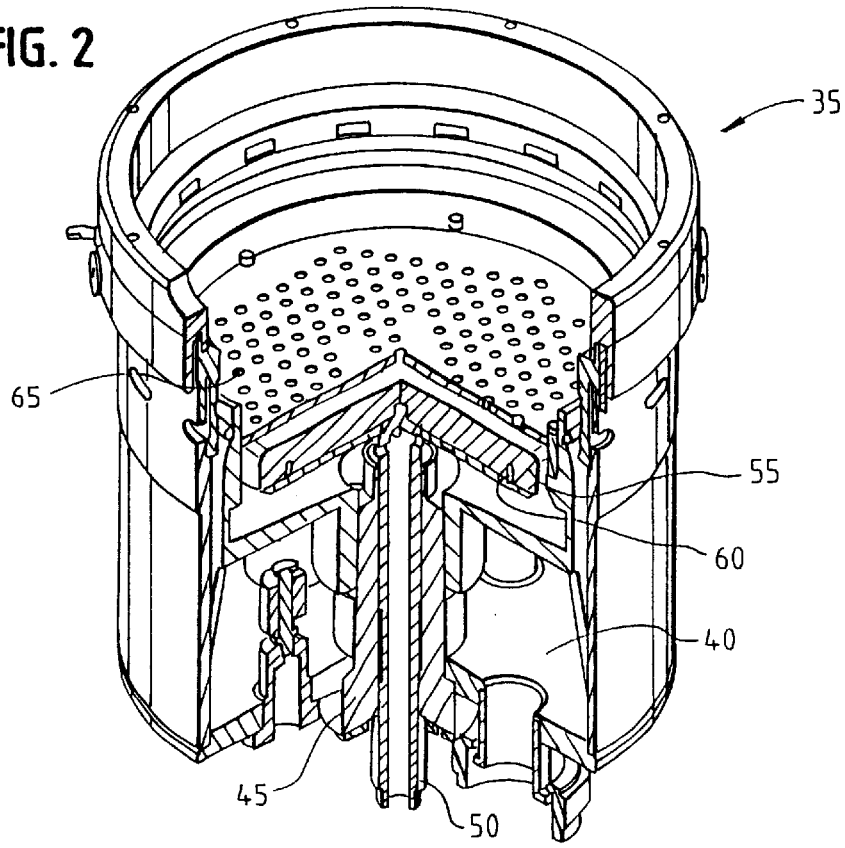
FIG. 2 illustrates a specific construction of one embodiment of a reactor bowl suitable for use in the assembly illustrated in FIG. 1.
Figure 3:
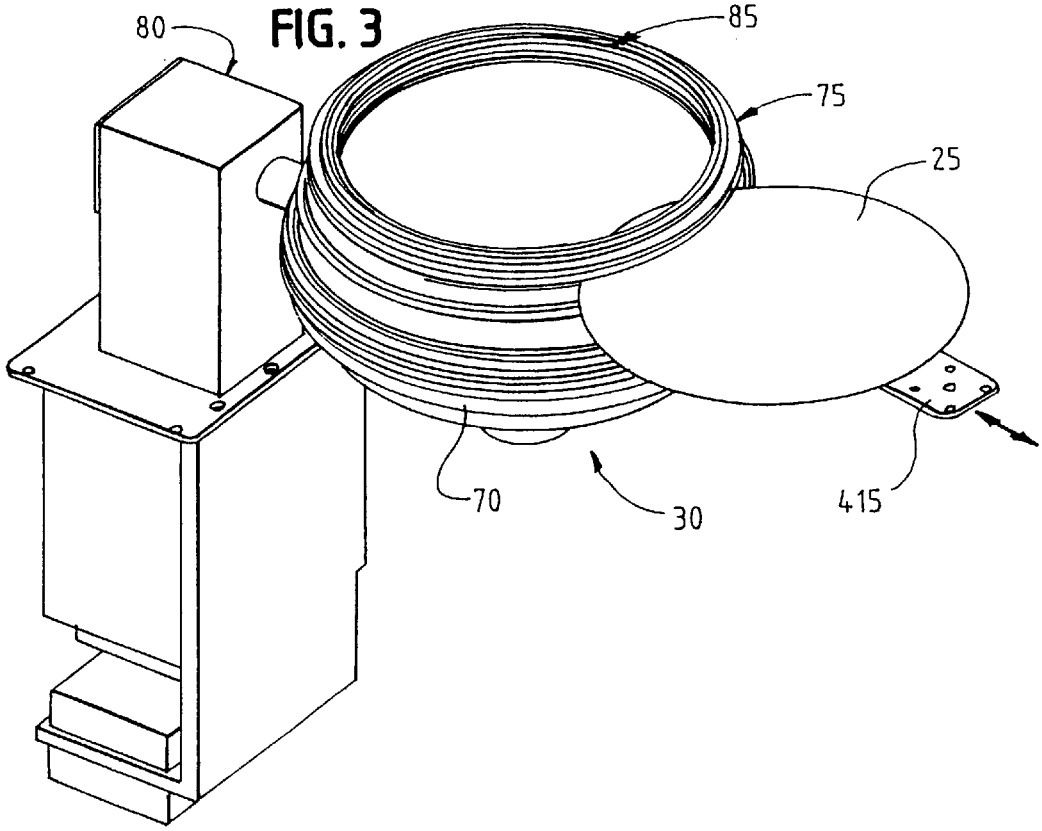
FIG. 3 illustrates one embodiment of a reactor head, comprised of a stationary assembly and a rotor assembly that is suitable for use in the assembly illustrated in FIG. 1.

With reference to FIGS. 1–3, there is shown a reactor assembly 20 for high deposition rate electroplating of solder on a microelectronic workpiece, such as a semiconductor wafer 25. Generally stated, the reactor assembly 20 is comprised of a reactor head 30 and a corresponding reactor bowl 35. This type of reactor assembly is particularly suited for effecting electroplating of semiconductor wafers or like workpieces, in which an electrically conductive, thin-film seed layer of the wafer is electroplated with a blanket or patterned metallic layer, such as a layer of solder bumps.

The specific construction of one embodiment of a reactor bowl 35 suitable for use in the reactor assembly 20 is illustrated in FIG. 2. The electroplating reactor bowl 35 is that portion of the reactor assembly 20 that contains electroplating solution, and that directs the solution at a high flow rate against a generally downwardly facing surface of an associated workpiece 25 to be plated. To this end, electroplating solution is circulated through the reactor bowl 35. Attendant to solution circulation, the solution flows from the reactor bowl 35, over the weir-like periphery of the bowl, into a lower overflow chamber 40 of the reactor assembly 20. Solution is drawn from the overflow chamber typically for re-circulation through the reactor.

The temperature of electroplating solution is monitored and maintained by a temperature sensor and heater, respectively. The sensor and heater are disposed in the circulation path of the electroplating solution. These components preferably maintain the temperature of the electroplating solution in a temperature range between 20° C. and 50° C. Even more preferably, these components maintain the temperature of the electroplating solution at about 30° C. +/5° C. As will be explained in connection with the preferred electroplating process, the preferred electroplating solution exhibits optimal deposition properties within this latter temperature range. The reactor bowl 35 includes a riser tube 45, within which an inlet conduit 50 is positioned for introduction of electroplating solution into the interior portion of the reactor bowl 35. The inlet conduit 50 is preferably conductive and makes electrical contact with and supports an electroplating anode 55. Unlike the inert anodes used in conventional electroplating of solder to a surface of a microelectronic workpiece, anode 55 is a consumable anode formed from tin and/or lead whereby tin and lead ions of the anode are transported by the electroplating solution to the electrically-conductive surface of the workpiece, which functions as a cathode. Preferably, the consumable anode 55 has a tin/lead composition that directly corresponds to the tin/lead composition required for the solder deposit. As such, an anode used in an electroplating system for depositing high lead content solder should have a corresponding high lead-tin ratio. Similarly, an anode used in an electroplating system for depositing eutectic solder should have a corresponding low lead-tin ratio. As illustrated, the anode 55 may be provided with an anode shield 60.

Electroplating solution flows at a high flow rate (i.e., 5 g/m) from the inlet conduit 50 through openings at the upper portion thereof. From there, the solution flows about the anode 55, and through an optional diffusion plate 65 positioned in operative association with and between the cathode (workpiece) and the anode.

The reactor head 30 of the electroplating reactor 20 is preferably comprised of a stationary assembly 70 and a rotor assembly 75, diagrammatically illustrated in FIG. 3. Rotor assembly 75 is configured to receive and carry an associated wafer 25 or like workpiece, position the wafer in a process-side down orientation within reactor bowl 35, and to rotate or spin the workpiece while joining its electrically-conductive surface in the plating circuit of the reactor assembly 20. The reactor head 30 is typically mounted on a lift/rotate apparatus 80, which is configured to rotate the reactor head 30 from an upwardly-facing disposition, in which it receives the wafer to be plated, to a downwardly facing disposition, in which the surface of the wafer to be plated is positioned downwardly in reactor bowl 35, generally in confronting relationship to diffusion plate 65. A robotic arm 415, including an end effector, is typically employed for placing the wafer 25 in position on the rotor assembly 75, and for removing the plated wafer from the rotor assembly.

ELECTROPLATING SOLUTION

The preferred electroplating solution is comprised of methane sulfonic acid, a source of lead ions, a source of tin ions, one or more organic additives, and deionized water. Complementary sets of materials that are specifically designed for electroplating a tin/lead solder composition are available from LeaRonal, Enthone-OMI, Lucent, and Technic.

The chemical salts used for the generation of lead and tin ions are provided in a ratio that corresponds, although not necessarily directly, to the lead-to-tin ratio of the required solder deposit. Two solder deposit compositions that are typically used for attachment of semiconductor integrated circuits using flip-chip technology are eutectic solder (63% Sn, 37% Pb) and high lead solder (95% to 97% Pb, with the balance being Sn). Electroplating solutions used for electroplating a eutectic solder thus have a higher concentration of tin than of lead. Similarly, electroplating solutions used for electroplating high lead solder have a higher concentration of lead than of tin. Although there is a correspondence between the general ratios of the lead and tin used for depositing a given solder composition, this correspondence is not necessarily one-to-one. This is due to the fact that the efficiencies associated with plating lead from the solution may be significantly lower than the efficiencies associated with plating tin from the solution (i.e., it is more difficult to plate lead from the solution than it is to plate tin from the solution).

The overall combined concentration of the metal ions of lead and tin utilized in the electroplating solution is dependent on the requisite rate of deposition, the particular compositions of the lead and tin concentrates (which often differs between manufacturers), the composition of the consumable anode 55, the operating temperature of the solution, cathode current density, and the desired composition of the solder deposit. The combined metal concentration should be chosen so that it is large enough to meet the requisite deposition rate while not so large as to evolve a significant amount of gas by-products that interfere with the plating process or otherwise result in unsatisfactory solder deposits. For a high rate plating of high lead content solder, the combined metal concentration is preferably between 55 g/liter and 205 g/liter. For a high rate plating of eutectic solder, lower combined metal concentrations may be used in view of the lower lead composition of the eutectic solder deposit.

The present inventors have found that high rate plating of about 4 microns/minute may be achieved with the following electroplating solutions, in which the particular additives are provided by the identified manufacturer. The compositions for these electroplating solutions are set forth in the following tables, and are directed to high rate plating of high lead content solder (95/5). It is believed that plating rates as high as 8 microns/minute are possible using these basic solutions and the reactor described above.

TABLE 1

| | |
|---|---|
| MANUFACTURER/BRAND-NAME | LeaRonal Solderon SC ™ |
| METHANE SULFONIC ACID | 120–180 g/liter - preferably, 150 g/liter |
| LEAD CONCENTRATION | 50–100 g/liter - preferably, 75 g/liter |
| TIN CONCENTRATION | 3–7 g/liter - preferably, 5 g/liter |
| ORGANIC ADDITIVE | 20%–30% by volume |
| WATER | 50%–60% by volume |

TABLE 2

| | |
|---|---|
| MANUFACTURER/BRAND-NAME | LeaRonal MHS-L ™ |
| METHANE SULFONIC ACID | 120–180 g/liter |
| LEAD CONCENTRATION | 130–170 g/liter |
| TIN CONCENTRATION | 15–35 g/liter |
| ORGANIC ADDITIVE | 20%–30% by volume |
| WATER | 50%–60% by volume |

TABLE 3

| | |
|---|---|
| MANUFACTURER/BRAND-NAME | Lucent |
| METHANE SULFONIC ACID | 20%–30% by volume |
| LEAD CONCENTRATE CONCENTRATION | 8%–10% by volume |
| TIN CONCENTRATE CONCENTRATION | 3%–5% by volume |
| ORGANIC ADDITIVE | 6%–8% by volume |
| WATER | 60%–70% by volume |

TABLE 4

| | |
|---|---|
| MANUFACTURER/BRAND-NAME | Technic |
| TECHNI ACID NF | 15% by volume |
| TECHNI LEAD NF 500 CONCENTRATION | 5% by volume |
| TECHNI TIN NF 300 CONCENTRATION | 13.3% by volume |
| TECHNI NF 820 HS MAKEUP | 5% by volume |
| TECHNI NF 820 HS SECONDARY ADDITIVE | 0.3% by volume |
| WATER | balance of remaining volume % |

The foregoing solution compositions can also be adjusted with respect to the lead and tin concentrations to optimize those solutions for depositing eutectic solder. For example, the solution compositions set forth in TABLE 5 below may be used to deposit eutectic solder at a high plating rate of about 2 microns/minute with excellent results. It is expected that a solution in which the tin and lead additive concentrations are doubled will produce a eutectic solder deposit at a high plating rate of about 4 microns/minute.

TABLE 5

| | |
|---|---|
| MANUFACTURER/BRAND-NAME | LeaRonal Solderon SC ™ |
| METHANE SULFONIC ACID | 120–180 g/liter - preferably, 150 g/liter |
| LEAD CONCENTRATION | about 10 g/liter |
| TIN CONCENTRATION | about 23.5 g/liter |
| ORGANIC ADDITIVE | 20%–30% by volume |
| WATER | 50%–60% by volume |

EXEMPLARY PROCESS

The reactor system and electroplating solutions described above can be used to implement a process for depositing lead-tin solder at a high rate of deposition in excess of about 2 microns/minute and potentially as high as 8 microns/minute. An exemplary process sequence preferably includes the following processing steps:

1. Pre-wet the substrate material using deionized water or acid and/or a surfactant to eliminate the dry plating surface (about 30 seconds) (the pre-wet solution may also include an amount of MSA and be heated to the same temperature at which electroplating will occur);
2. Adjust and/or program the electroplating system for the following processing parameters: electroplating flow set-point at nominal 5 gpm (or other high flow rate of comparable magnitude), electroplating bath temperature about 20° C.–50° C. (preferably, about 30° C.), rotate workpiece at a rotation rate between about 1 and 100 rpm (preferably, about 20 rpm), change the direction of the rotation at intervals between about 5 and 60 seconds;
3. Bring the surface of the workpiece that is to be plated into contact with the electroplating solution without application of electroplating power thereby inducing an acid etch of the substrate (about 30 seconds);
4. Apply electroplating power at a current set-point that is between about 50 and 200 milliamps/cm$^2$(time duration dependent on desired vertical plate height or bump volume);
5. Halt electrolysis;
6. Disengage workpiece from electroplating solution;
7. Spin the workpiece at a high spin rate (i.e., above about 200 rpm) to remove excess electroplating solution;
8. Rinse the workpiece in a spray of deionized water (about 2 min.) and spin dry at a high rotation rate.

Other processing sequences may also be used to provide high-quality solder deposits that are deposited at a high deposition rate, the foregoing processing steps and sequence being illustrative. As will be set forth in further detail below, the foregoing processing steps and sequence may be implemented in a single fabrication tool having a plurality of similar processing stations and a programmable robot that transfers the workpieces between such stations.

There are a number of enhancements that may be made to the reactor assembly 20 described above that facilitate uniformity of the solder deposits over the face of the workpiece. For example, the reactor assembly 20 may use a contact assembly that reduces non-uniformities in the deposit that occur proximate the discrete contacts that are used to provide plating power to the surface at the perimeter of the workpiece. Additionally, other enhancements to the reactor assembly 20 may be added to facilitate routine service and/or configurability of the system.

IMPROVED CONTACT ASSEMBLIES FOR ELECTROPLATING SOLDER

The manner in which the electroplating power is supplied to the wafer at the peripheral edge thereof is very important to the overall film quality of the deposited solder. Some of the more desirable characteristics of a contact assembly used to provide such electroplating power include, for example, the following:

- uniform distribution of electroplating power about the periphery of the wafer to maximize the uniformity of the deposited film;
- consistent contact characteristics to insure wafer-to-wafer uniformity;
- minimal intrusion of the contact assembly on the wafer periphery to maximize the available area for device production; and
- minimal plating on the barrier layer about the wafer periphery to inhibit peeling and/or flaking.

To meet one or more of the foregoing characteristics, reactor 20 preferably employs a ring contact assembly 85 that provides either a continuous electrical contact or a high number of discrete electrical contacts with the wafer 25. By providing a more continuous contact with the outer peripheral edges of the semiconductor wafer 25, in this case around the outer circumference of the semiconductor wafer, a more uniform current is supplied to the semiconductor wafer 25 that promotes more uniform current densities. The more uniform current densities enhance uniformity in the depth of the deposited material.

Contact assembly 85, in accordance with a preferred embodiment, includes contact members that provide minimal intrusion about the wafer periphery while concurrently providing consistent contact with the seed layer. Contact with the seed layer is enhanced by using a contact member structure that provides a wiping action against the seed layer as the wafer is brought into engagement with the contact assembly. This wiping action assists in removing any oxides at the seed layer surface thereby enhancing the electrical contact between the contact structure and the seed layer. As a result, uniformity of the current densities about the wafer periphery are increased and the resulting film is more uniform. Further, such consistency in the electrical contact facilitates greater consistency in the electroplating process from wafer-to-wafer thereby increasing wafer-to-wafer uniformity.

Contact assembly 85, as will be set forth in further detail below, also preferably includes one or more structures that provide a barrier, individually or in cooperation with other structures, that separates the contact/contacts, the peripheral edge portions and backside of the semiconductor wafer 25 from the plating solution. This prevents the plating of metal onto the individual contacts and, further, assists in preventing any exposed portions of the barrier layer near the edge of the semiconductor wafer 25 from being exposed to the electroplating environment. As a result, plating of the barrier layer and the appertaining potential for contamination due to flaking of any loosely adhered electroplated material is substantially limited.

RING CONTACT ASSEMBLIES USING FLEXURE CONTACTS

One embodiment of a contact assembly suitable for use in the assembly 20 is shown generally at 85 of FIGS. 4–10. The contact assembly 85 forms part of the rotor assembly 75 and provides electrical contact between the semiconductor wafer 25 and a source of electroplating power. In the illustrated embodiment, electrical contact between the semiconductor wafer 25 and the contact assembly 85 occurs at a large plurality of discrete flexure contacts 90 that are effectively separated from the electroplating environment interior of the reactor bowl 35 when the semiconductor wafer 25 is held and supported by the rotor assembly 75.

Figure 4:
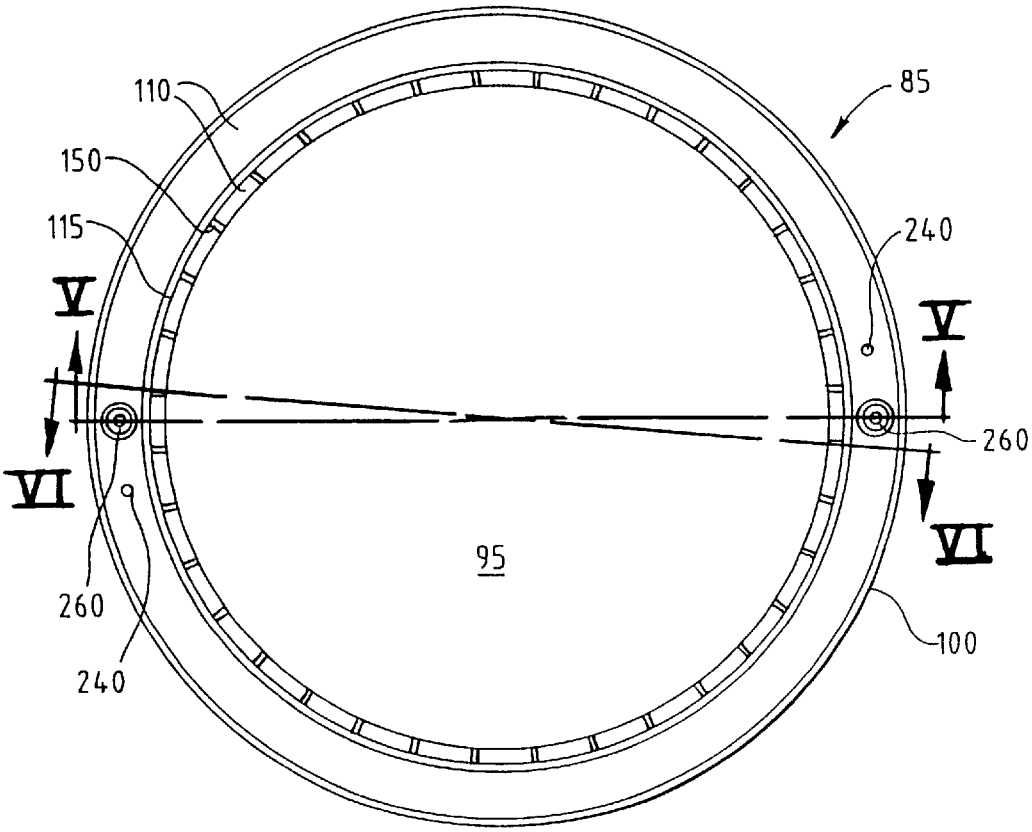
FIGS. 4–10 illustrate one embodiment of a contact assembly using flexure contacts that is suitable for use in the reactor assembly illustrated in FIG. 1.
Figure 6:
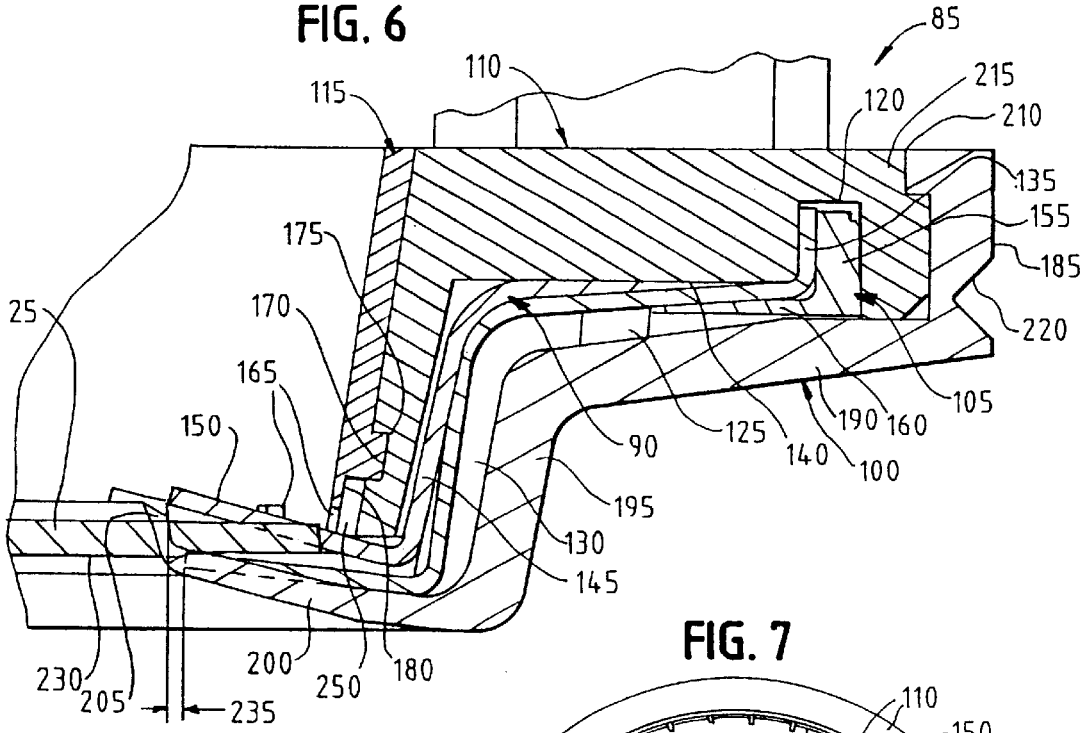

The contact assembly 85 may be comprised of several discrete components. With reference to FIG. 4, when the workpiece that is to be electroplated is a circular semiconductor wafer, the discrete components of the contact assembly 85 join together to form a generally annular component having a bounded central open region 95. It is within this bounded central open region 95 that the surface of the semiconductor wafer that is to be electroplated is exposed. With particular reference to FIG. 6, contact assembly 85 includes an outer body member 100, an annular wedge 105, a plurality of flexure contacts 90, a contact mount member 110, and an interior wafer guide 115. Preferably, annular wedge 105, flexure contacts 90, and contact mount member 110 are formed from platinized titanium while wafer guide 115 and outer body member 100 are formed from a dielectric material that is compatible with the electroplating environment. Annular wedge 105, flexure contacts 90, mount member 110, and wafer guide 115 join together to form a single assembly that is secured together by outer body member 100.

As shown in FIG. 6, contact mount member 100 includes a first annular groove 120 disposed about a peripheral portion thereof and a second annular groove 125 disposed radially inward of the first annular groove 120. The second annular groove 125 opens to a plurality of flexure channels 130 that are equal in number to the number of flexure contacts 90. As can be seen from FIG. 4, a total of 36 flexure contacts 90 are employed, each being spaced from one another by an angle of about 10 degrees.

Referring again to FIG. 6, each flexure contact 90 is comprised of an upstanding portion 135, a transverse portion 140, a vertical transition portion 145, and a wafer contact portion 150. Similarly, wedge 105 includes an upstanding portion 155 and a transverse portion 160. Upstanding portion 155 of wedge 105 and upstanding portion 135 of each flexure contact 90 are secured within the first annular groove 120 of the contact mount member 110 at the site of each flexure channel 130. Self-adjustment of the flexure contacts 90 to their proper position within the overall contact assembly 85 is facilitated by first placing each of the individual flexure contacts 90 in its respective flexure channel 130 so that the upstanding portion 135 is disposed within the first annular groove 120 of the contact mount member 110 while the transition portion 145 and contact portion 150 proceed through the respective flexure channel 130. The upstanding portion 155 of wedge member 105 is then urged into the first annular groove 120. To assist in this engagement,.the upper end of upstanding portion 155 is tapered. The combined width of upstanding portion 135 of the flexure contact 90 and upstanding portion 155 of wedge 105 are such that these components are firmly secured with contact mount member 110.

Transverse portion 160 of wedge 105 extends along a portion of the length of transverse portion 140 of each flexure 90. In the illustrated embodiment, transverse portion 160 of wedge portion 105 terminates at the edge of the second annular groove 125 of contact mount member 110. As will be more clear from the description of the flexure contact operation below, the length of transverse portion 160 of wedge 105 can be chosen to provide the desired degree of stiffness of the flexure contacts 90.

Wafer guide 115 is in the form of an annular ring having a plurality of slots 165 through which contact portions 150 of flexures 90 extend. An annular extension 170 proceeds from the exterior wall of wafer guide 115 and engages a corresponding annular groove 175 disposed in the interior wall of contact mount member 110 to thereby secure the wafer guide 115 with the contact mount member 110. As illustrated, the wafer guide member 115 has an interior diameter that decreases from the upper portion thereof to the lower portion thereof proximate contact portions 150. A wafer inserted into contact assembly 85 is thus guided into position with contact portions 150 by a tapered guide wall formed at the interior of wafer guide 115. Preferably, the portion 180 of wafer guide 115 that extends below annular extension 170 is formed as a thin, compliant wall that resiliently deforms to accommodate wafers having different diameters within the tolerance range of a given wafer size. Further, such resilient deformation accommodates a range of wafer insertion tolerances occurring in the components used to bring the wafer into engagement with the contact portions 150 of the flexures 90.

Referring to FIG. 6, outer body member 100 includes an upstanding portion 185, a transverse portion 190, a vertical transition portion 195 and a further transverse portion 200 that terminates in an upturned lip 205. Upstanding portion 185 includes an annular extension 210 that extends radially inward to engage a corresponding annular notch 215 disposed in an exterior wall of contact mount member 110. A V-shaped notch 220 is formed at a lower portion of the upstanding portion 185 and circumvents the outer periphery thereof. The V-shaped notch 220 allows upstanding portion 185 to resiliently deform during assembly. To this end, upstanding portion 185 resiliently deforms as annular extension 210 slides about the exterior of contact mount member 110 to engage annular notch 215. Once so engaged, contact mount member 110 is clamped between annular extension 210 and the interior wall of transverse portion 190 of outer body member 100.

Further transverse portion 200 extends beyond the length of contact portions 150 of the flexure contacts 90 and is dimensioned to resiliently deform as a wafer, such as at 25, is driven against them. V-shaped notch 220 may be dimensioned and positioned to assist in the resilient deformation of transverse portion 200. With the wafer 25 in proper engagement with the contact portions 150, upturned lip 205 engages wafer 25 and assists in providing a barrier between the electroplating solution and the outer peripheral edge and backside of wafer 25, including the flexure contacts 90.

As illustrated in FIG. 6, flexure contacts 90 resiliently deform as the wafer 25 is driven against them. Preferably, contact portions 150 are initially angled upward in the illustrated manner. Thus, as the wafer 25 is urged against contact portions 150, flexures 90 resiliently deform so that contact portions 150 effectively wipe against surface 230 of wafer 25. In the illustrated embodiment, contact portions 150 effectively wipe against surface 230 of wafer 25 a horizontal distance designated at 235. This wiping action assists in removing and/or penetrating any oxides from surface 230 of wafer 25 thereby providing more effective electrical contact between flexure contacts 90 and the seed layer at surface 230 of wafer 25.

Figure 7:
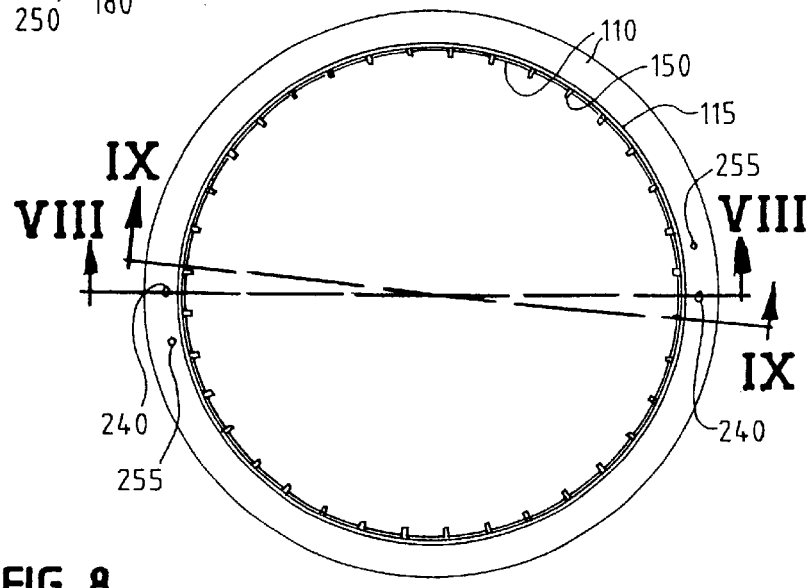
Figure 8:
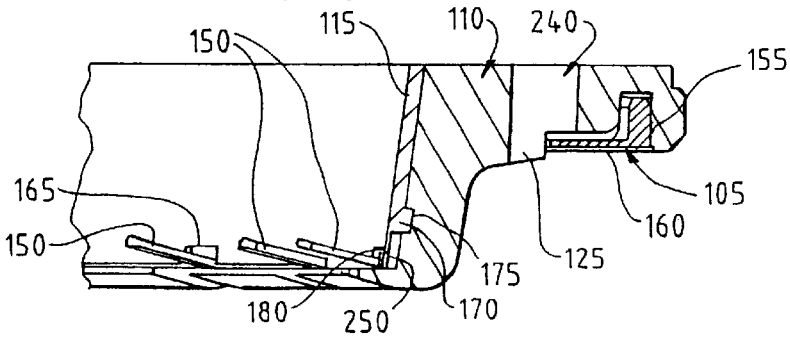
Figure 9:
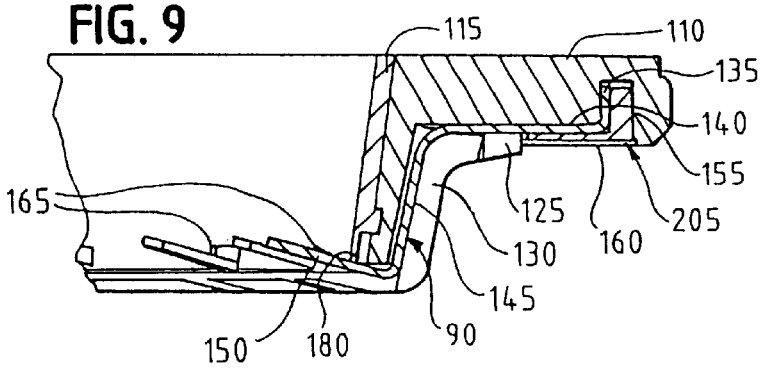

With reference to FIGS. 7 and 8, contact mount member 110 is provided with one or more ports 240 that may be connected to a source of purging gas, such as a source of nitrogen. As shown in FIG. 8, purge ports 240 open to second annular groove 125 which, in turn, operates as a manifold to distribute the purging gas to all of the flexure channels 130 as shown in FIG. 6. The purging gas then proceeds through each of the flexure channels 130 and slots 165 to substantially surround the entire contact portions 150 of flexures 90. In addition to purging the area surrounding contact portions 150, the purge gas cooperates with the upturned lip 205 of outer body member 100 to effect a barrier to the electroplating solution. Further circulation of the purge gas is facilitated by an annular channel 250 formed between a portion of the exterior wall of wafer guide 115 and a portion of the interior wall of contact mount member 110.

Figure 5:
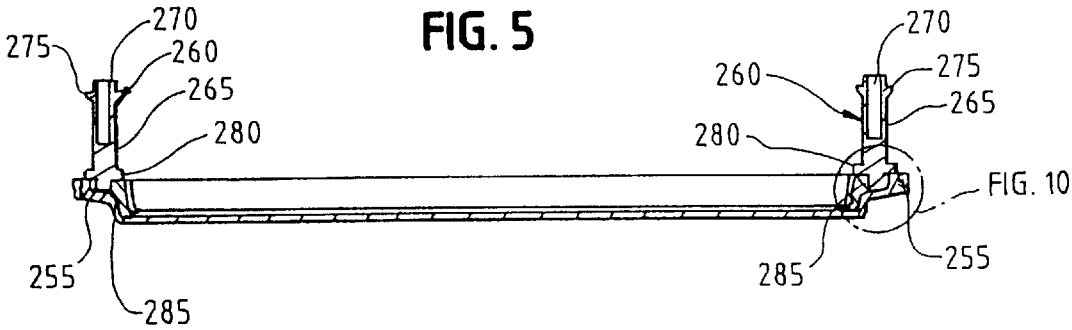
Figure 10:
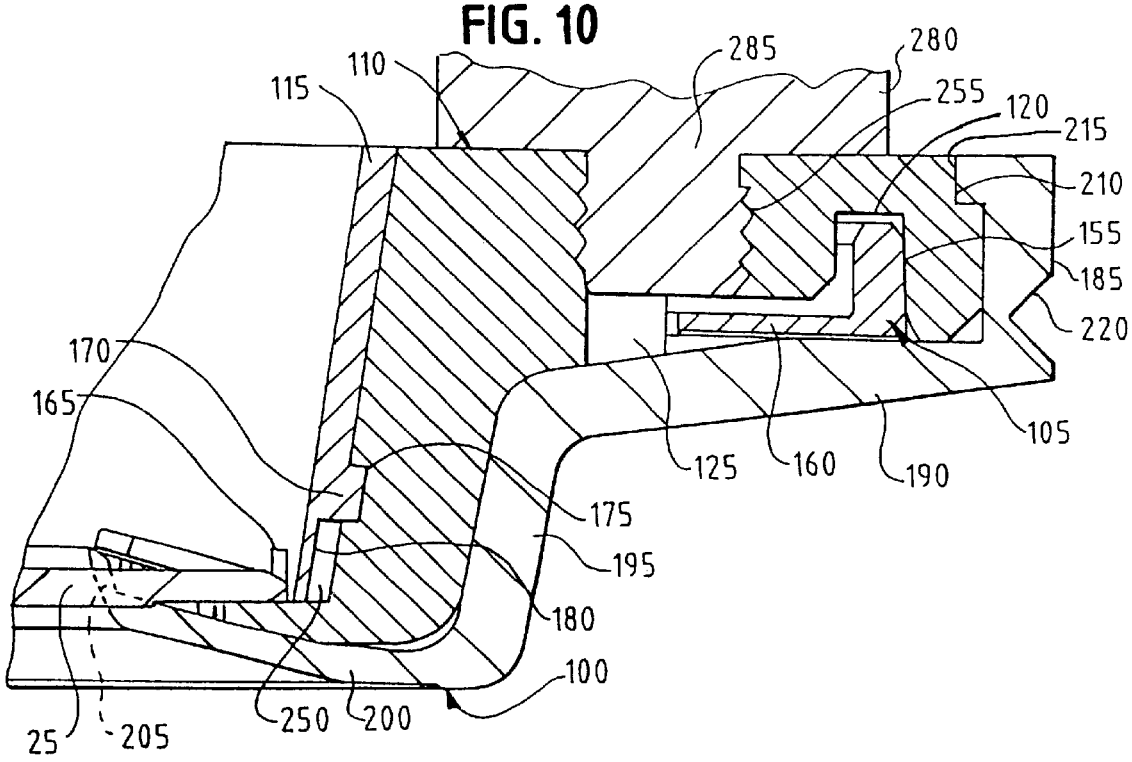
Figure 11A:
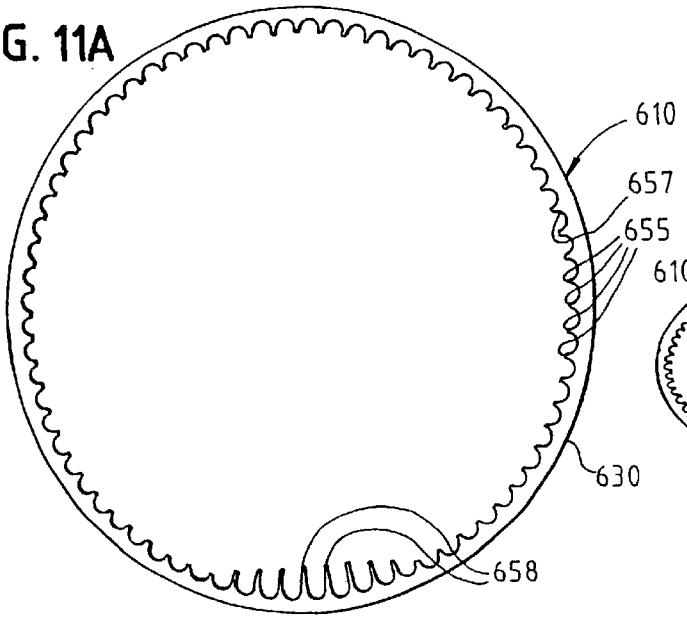
FIGS. 11A and B and 12 illustrate two different embodiments of a "Belleville ring" contact structure.
Figure 11B:
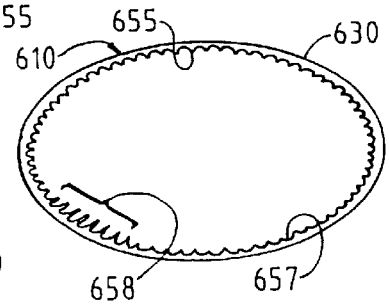

As shown in FIGS. 4, 5 and 10, contact mount member 110 is provided with one or more threaded apertures 255 that are dimensioned to accommodate a corresponding connection plug 260. With reference to FIGS. 5 and 10, connection plugs 260 provide electroplating power to the contact assembly 85 and, preferably, are each formed from platinized titanium. In a preferred form of plugs 260, each plug 260 includes a body 265 having a centrally disposed bore hole 270. A first flange 275 is disposed at an upper portion of body 265 and a second flange 280 is disposed at a lower portion of body 265. A threaded extension 285 proceeds downward from a central portion of flange 280 and secures with threaded bore hole 270. The lower surface of flange 280 directly abuts an upper surface of contact mount member 110 to increase the integrity of the electrical connection therebetween.

Although flexure contacts 90 are formed as discrete components, they may be joined with one another as an integral assembly. To this end, for example, the upstanding portions 135 of the flexure contacts 90 may be joined to one another by a web of material, such as platinized titanium, that is either formed as a separate piece or is otherwise formed with the flexures from a single piece of material. The web of material may be formed between all of the flexure contacts or between select groups of flexure contacts. For example, a first web of material may be used to join half of the flexure contacts (e.g., 18 flexure contacts in the illustrated embodiment) while a second web of material is used to join a second half of the flexure contacts (e.g., the remaining 18 flexure contacts in the illustrated embodiment). Different groupings are also possible.

BELLEVILLE RING CONTACT ASSEMBLIES

Alternative contact assemblies are illustrated in FIGS. 11–15. In each of these contact assemblies, the contact members are integrated with a corresponding common ring and, when mounted in their corresponding assemblies, are biased upward in the direction in which the wafer or other substrate is received upon the contact members. A top view of one embodiment of such a structure is illustrated in FIG. 11A while a perspective view thereof is illustrated it FIG. 11B. As illustrated, a ring contact, shown generally at 610, is comprised of a common ring portion 630 that joins a plurality of contact members 655. The common ring portion 630 and the contact members 655, when mounted in the corresponding assemblies, are similar in appearance to half of a conventional Belleville spring. For this reason, the ring contact 610 will be hereinafter referred to as a "Bellville ring contact" and the overall contact assembly into which it is placed will be referred to as a "Bellville ring contact assembly".

The embodiment of Belleville ring contact 610 illustrated in FIGS. 16A and 16B includes 72 contact members 655 and is preferably in formed from platinized titanium. The contact members 655 may be formed by cutting arcuate sections 657 into the interior diameter of a platinized titanium ring. A predetermined number of the contact members 658 have a greater length than the remaining contact members 655 to, for example, accommodate certain flat-sided wafers.

Figure 12:
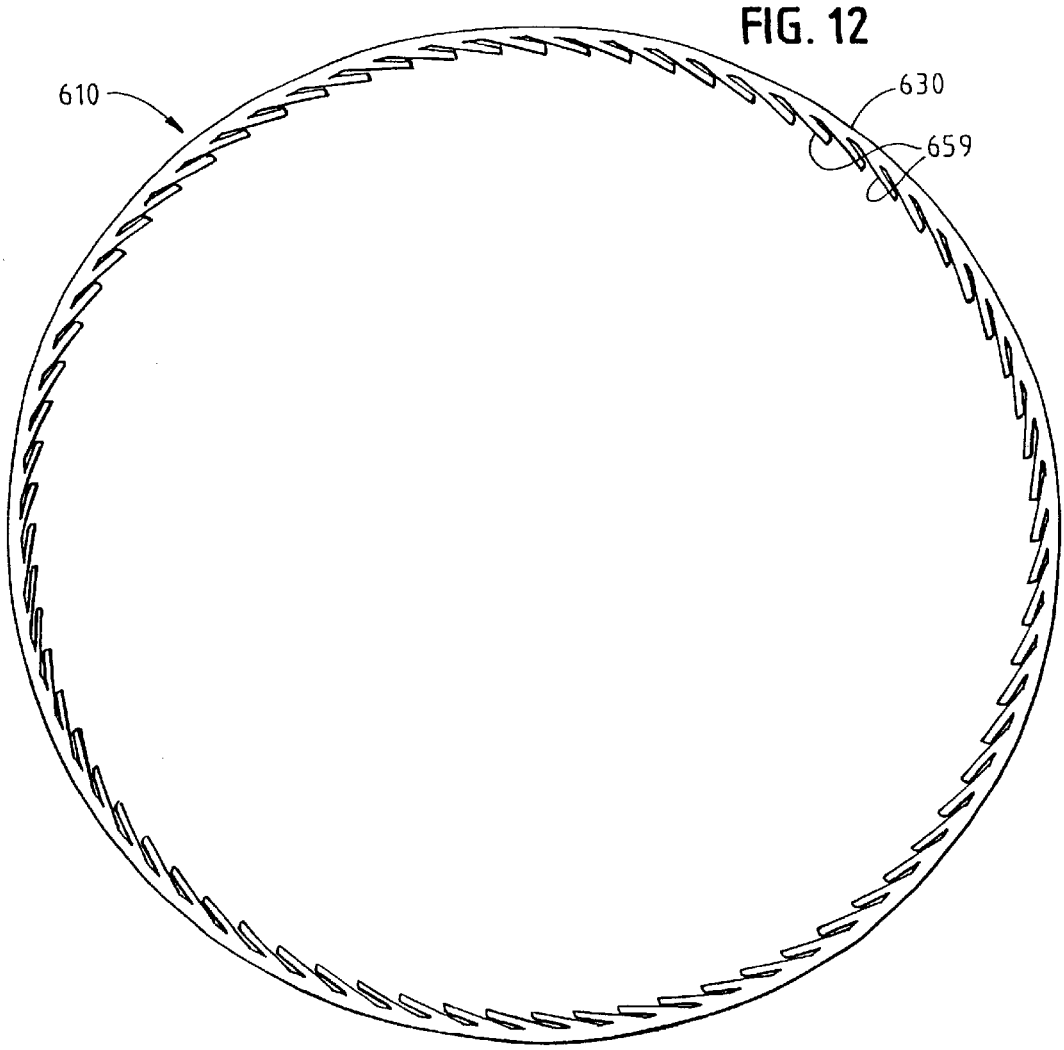

A further embodiment of a Belleville ring contact 610 is illustrated in FIG. 12. As above, this embodiment is preferably formed from platinized titanium. Unlike the embodiment of FIGS 11A and 11B in which all of the contact members 655 extend radially inward toward the center of the structure, this embodiment includes contact members 659 that are disposed at an angle. This embodiment constitutes a single-piece design that is easy to manufacture and that provides a more compliant contact than does the embodiment of FIGS. 11A and 11B with the same footprint. This contact embodiment can be fixtured into the "Belleville" form in the contact assembly and does not require permanent forming. If the Belleville ring contact 610 of this embodiment is fixtured in place, a complete circumferential structure is not required. Rather the contact may be formed and installed in segments thereby enabling independent control/sensing of the electrical properties of the segments.

Figure 13:
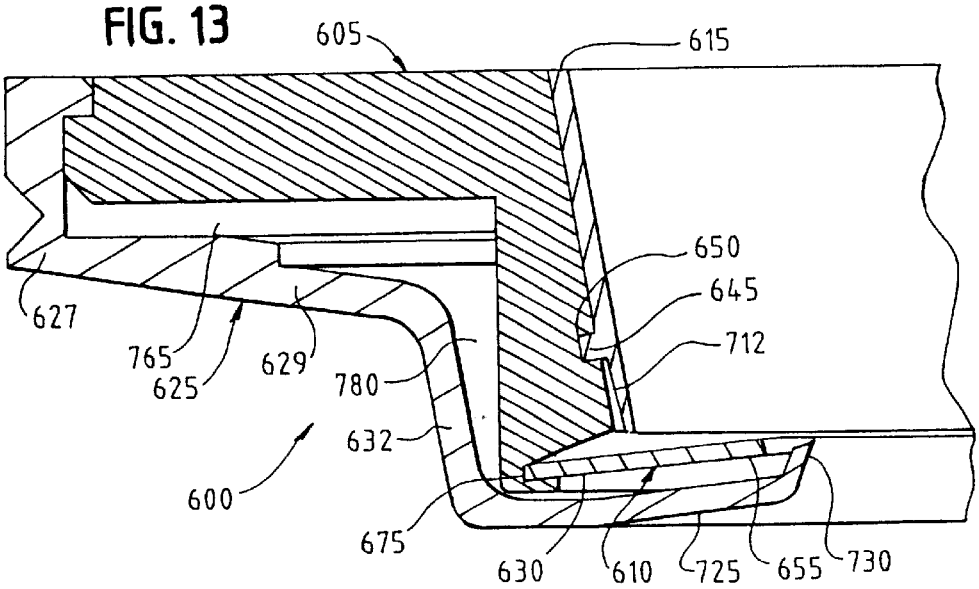
FIGS. 13–15 illustrate one embodiment of a contact assembly using a "Belleville ring" contact structure, such as one of those illustrated in FIGS. 11–12, that is suitable for use in the reactor assembly illustrated in FIG. 1.
Figure 14:
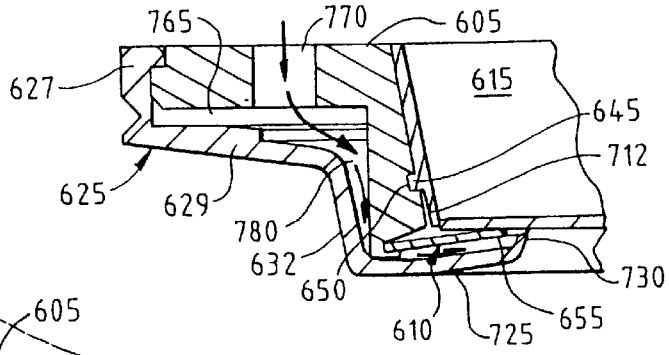
Figure 15:
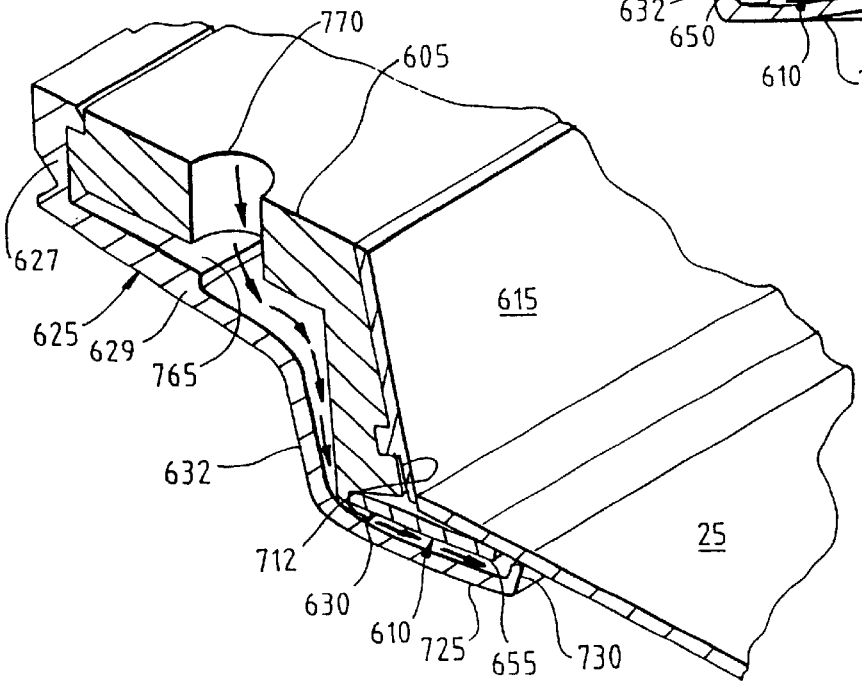

A first embodiment of a Bellville ring contact assembly is illustrated generally at 600 in in FIGS. 13–15. As illustrated, the contact assembly 600 comprises a conductive contact mount member 605, a Bellville ring contact 610, a dielectric wafer guide ring 615, and an outer body member 625. The outer, common portion 630 of the Bellville ring contact 610 includes a first side that is engaged within a notch 675 of the conductive base ring 605. In many respects, the Belleville ring contact assembly of this embodiment is similar in construction with the flexure contact assembly 85 described above. For that reason, the functionality of many of the structures of the contact assembly 600 will be apparent and will not be repeated here.

Preferably, the wafer guide ring 615 is formed from a dielectric material while contact mount member 605 is formed from a single, integral piece of conductive material or from a dielectric or other material that is coated with a conductive material at its exterior. Even more preferably, the conductive ring 605 and Bellville ring contact 610 are formed from platinized titanium or are otherwise coated with a layer of platinum.

The wafer guide ring 615 is dimensioned to fit within the interior diameter of the contact mount member 605. Wafer guide ring 615 has substantially the same structure as wafer guides 115 and 115*b* described above in connection with contact assemblies 85 and 85*b*, respectively. Preferably, the wafer guide ring 615 includes an annular extension 645 about its periphery that engages a corresponding annular slot 650 of the conductive base ring 605 to allow the wafer guide ring 615 and the contact mount member 605 to snap together.

The outer body member 625 includes an upstanding portion 627, a transverse portion 629, a vertical transition portion 632 and a further transverse portion 725 that extends radially and terminates at an upturned lip 730. Upturned lip 730 assists in forming a barrier to the electroplating environment when it engages the surface of the side of workpiece 25 that is being processed. In the illustrated embodiment, the engagement between the lip 730 and the surface of workpiece 25 is the only mechanical seal that is formed to protect the Bellville ring contact 610.

The area proximate the contacts 655 of the Belleville ring contact 610 is preferably purged with an inert fluid, such as nitrogen gas, which cooperates with lip 730 to effect a barrier between the Bellville ring contact 610, peripheral portions and the backside of wafer 25, and the electroplating environment. As particularly shown set forth in FIGS. 14 and 15, the outer body member 625 and contact mount member 605 are spaced from one another to form an annular cavity 765. The annular cavity 765 is provided with an inert fluid, such as nitrogen, through one or more purge ports 770 disposed through the contact mount member 605. The purged ports 770 open to the annular cavity 765, which functions as a manifold to distribute to the inert gas about the periphery of the contact assembly. A given number of slots, such as at 780, corresponding to the number of contact members 655 are provided and form passages that route the inert fluid from the annular cavity 765 to the area proximate contact members 655.

FIGS. 14 and 15 also illustrate the flow of a purging fluid in this embodiment of Bellville ring contact assembly. As illustrated by arrows, the purge gas enters purge port 770 and is distributed about the circumference of the assembly 600 within annular cavity 765. The purged gas then flows through slots 780 and below the lower end of contact mount member 605 to the area proximate Bellville contact 610. At this point, the gas flows to substantially surround the contact members 655 and, further, may proceed above the periphery of the wafer to the backside thereof. The purging gas may also proceed through an annular channel 712 defined by the contact mount member 605 and the interior of the compliant wall formed at the lower portion of wafer guide ring 615. Additionally, the gas flow about contact members 655 cooperates with upturned lip 730 effect a barrier at lip 730 that prevents electroplating solution from proceeding therethrough.

When a wafer or other workpiece 25 is urged into engagement with the contact assembly 600, the workpiece 25 first makes contact with the contact members 655. As the workpiece is urged further into position, the contact members 655 deflect and effectively wipe the surface of workpiece 25 until the workpiece 25 is pressed against the upturned lip 730. This mechanical engagement, along with the flow of purging gas, effectively isolates the outer periphery and backside of the workpiece 25 as well as the Bellville ring contact 610 from contact with the plating solution.

ROTOR CONTACT CONNECTION ASSEMBLY

In many instances, it may be desirable to have a given reactor assembly 20 function to execute a wide range of solder electroplating recipes. Execution of a wide range of electroplating recipes may be difficult, however, if the process designer is limited to using a single contact assembly construction. Further, the plating contacts used in a given contact assembly construction must be frequently inspected and, sometimes, replaced. This is often difficult to do in existing electroplating reactor tools, frequently involving numerous operations to remove and/or inspect the contact assembly. This problem may be addressed by providing a mechanism by which the contact assembly 85 is readily attached and detached from the other components of the rotor assembly 75. Further, a given contact assembly type can be replaced with the same contact assembly type without re-calibration or readjustment of the system.

To be viable for operation in a manufacturing environment, such a mechanism must accomplish several functions including:

1. Provide secure, fail-safe mechanical attachment of the contact assembly to other portions of the rotor assembly;
2. Provide electrical interconnection between the contacts of the contact assembly and a source of electroplating power;
3. Provide a seal at the electrical interconnect interface to protect against the processing environment (e.g., wet chemical environment);
4. Provide a sealed path for the purge gas that is provided to the contact assembly; and
5. Minimize use of tools or fasteners which can be lost, misplaced, or used in a manner that damages the electroplating equipment.

Figure 16:
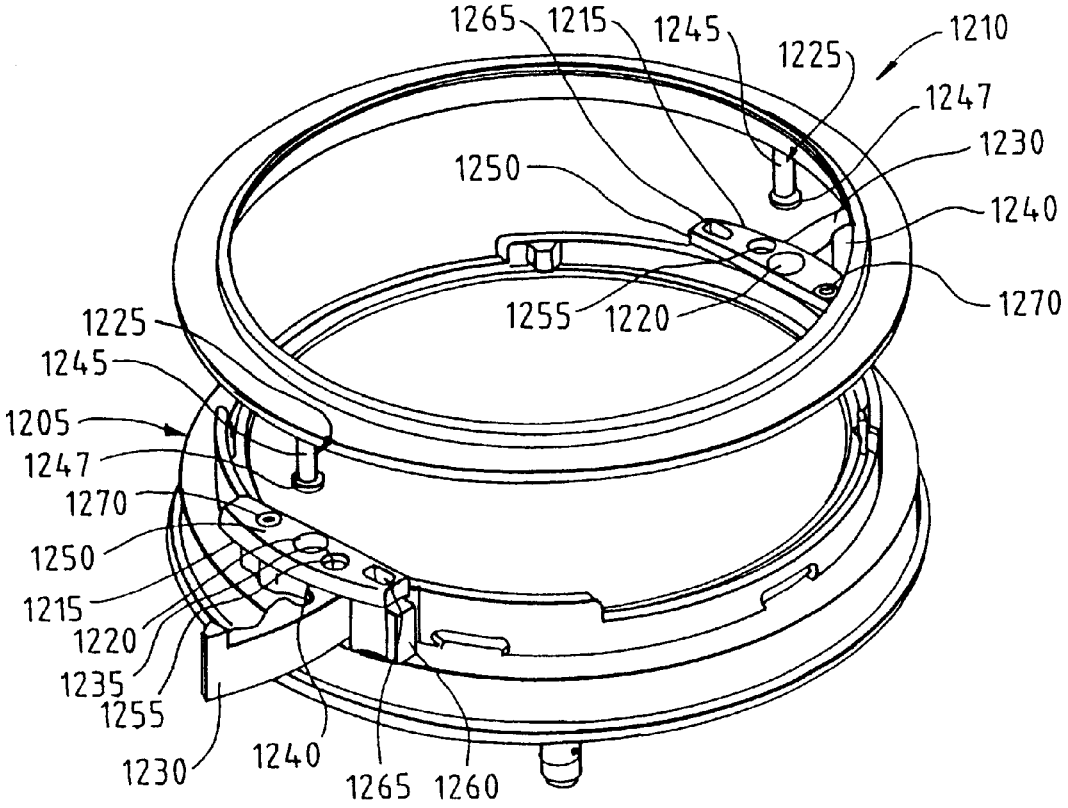
FIGS. 16–17, 18A–B, 19A–C, and 20A–D illustrate various aspects of one embodiment of a quick-attach mechanism.
Figure 17:
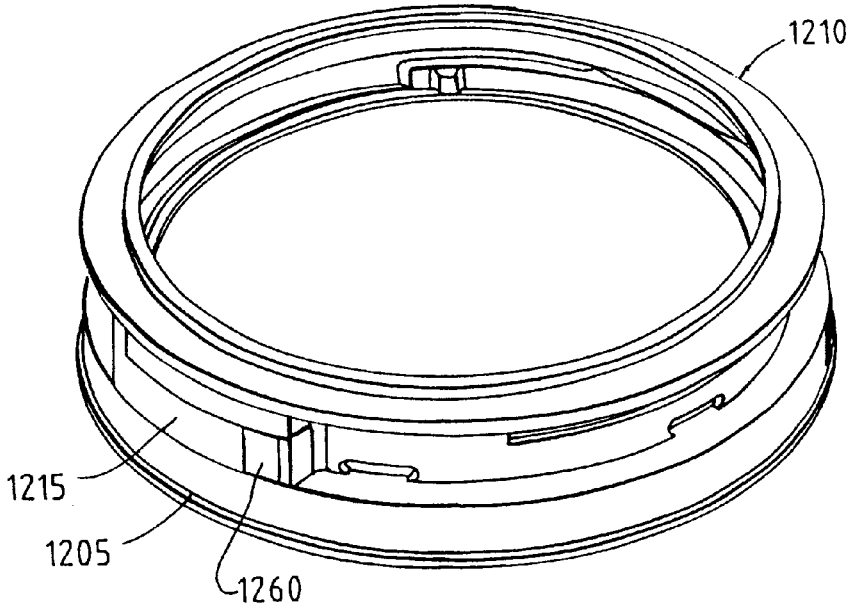

FIGS. 16 and 17 illustrate one embodiment of a quick-attach mechanism that meets the foregoing requirements. For simplicity, only those portions of the rotor assembly 75 necessary to understanding the various aspects of the quick-attach mechanism are illustrated in these figures.

As illustrated, the rotor assembly 75 may be comprised of a rotor base member 205 and a removable contact assembly 1210. Preferably, the removable contact assembly 1210 is constructed in the manner set forth above in connection with contact assembly 85. The illustrated embodiment, however, employs a continuous ring contact. It will be recognized that both contact assembly constructions are suitable for use with the quick-attachment mechanism set forth herein.

The rotor base member 1205 is preferably annular in shape to match the shape of the semiconductor wafer 25. A pair of latching mechanisms 1215 are disposed at opposite sides of the rotor base member 205. Each of the latching mechanisms 1215 includes an aperture 1220 disposed through an upper portion thereof that is dimensioned to receive a corresponding electrically conductive shaft 1225 that extends downward from the removable contact assembly 1210.

The removable contact assembly 1210 is shown in a detached state in FIG. 16. To secure the removable contact assembly 1210 to the rotor base member 1205, an operator aligns the electrically conductive shafts 1225 with the corresponding apertures 1220 of the latching mechanisms 1215. With the shafts 1225 aligned in this manner, the operator urges the removable contact assembly 1210 toward the rotor base member 1205 so that the shafts 1225 engage the corresponding apertures 1220. Once the removable contact assembly 1210 is placed on the rotor base member 1205, latch arms 1230 are pivoted about a latch arm axis 1235 so that latch arm channels 1240 of the latch arms 1230 engage the shaft portions 1245 of the conductive shafts 1235 while concurrently applying a downward pressure against flange portions 1247. This downward pressure secures the removable contact assembly 1210 with the rotor base assembly 1205. Additionally, as will be explained in further detail below, this engagement results in the creation of an electrically conductive path between electrically conductive portions of the rotor base assembly 1205 and the electroplating contacts of the contact assembly 1210. It is through this path that the electroplating contacts of the contact assembly 1210 are connected to receive power from a plating power supply.

Figure 18A:
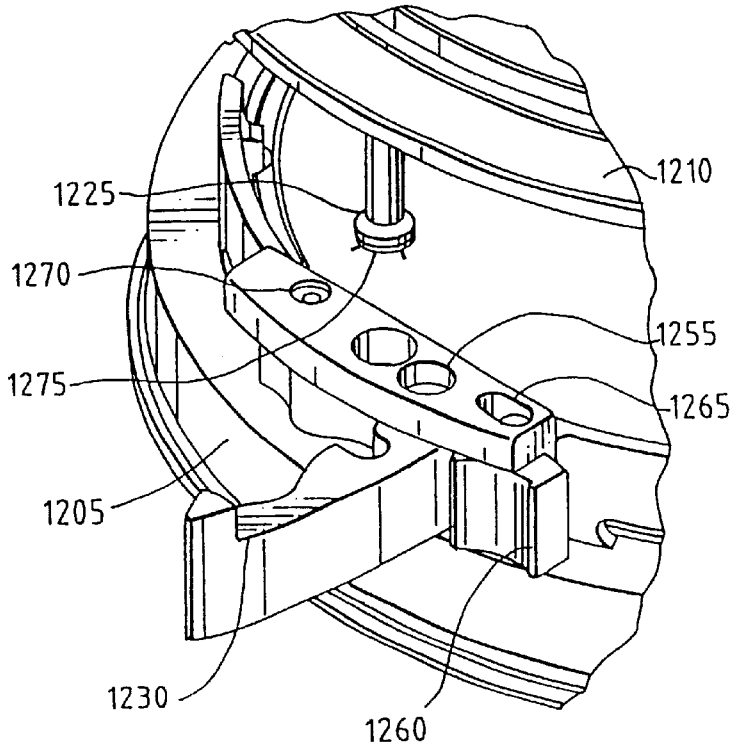
Figure 18B:
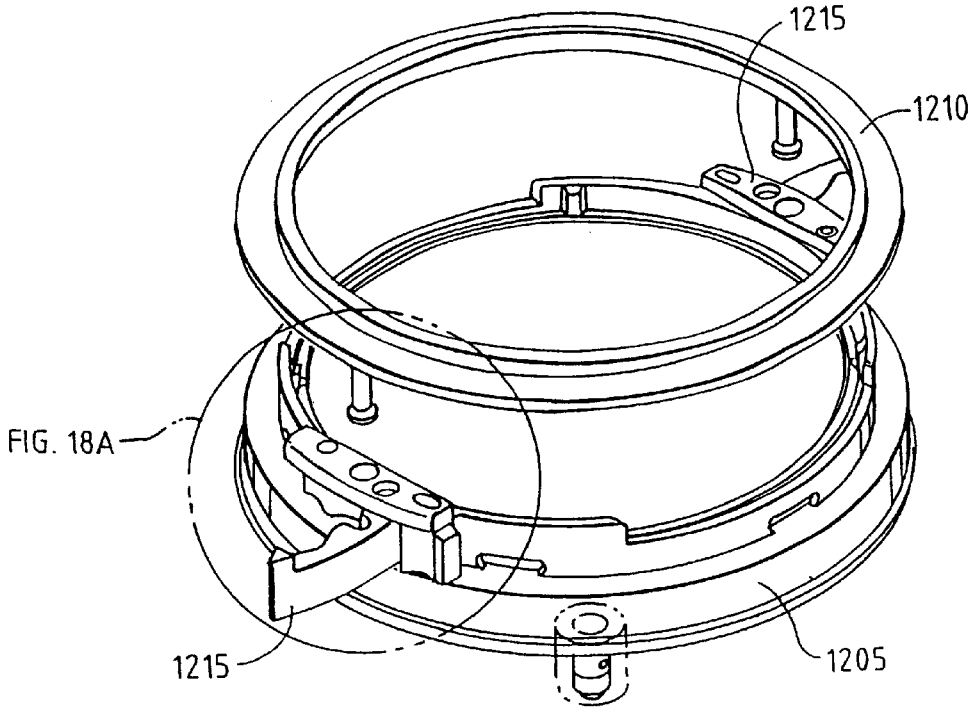
Figure 19A:
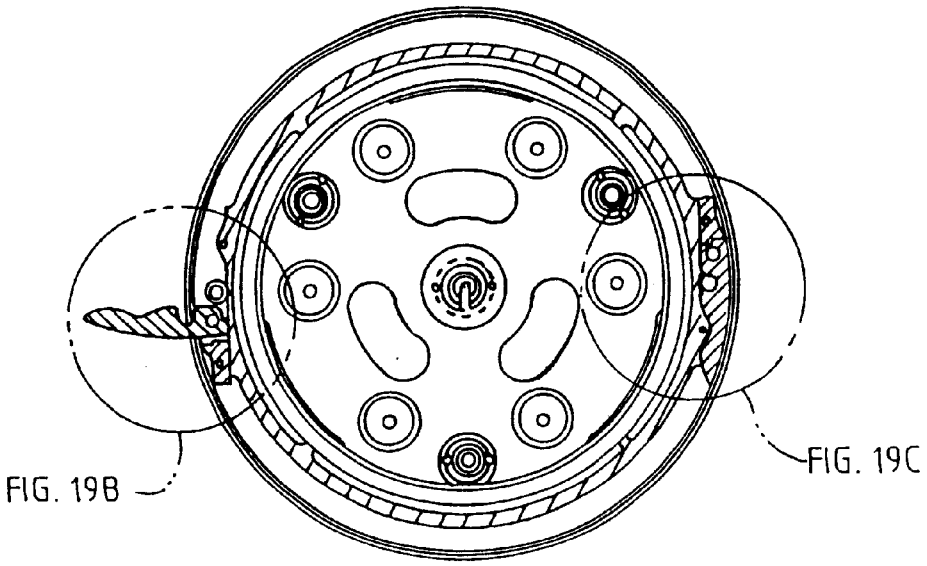
Figure 19B:
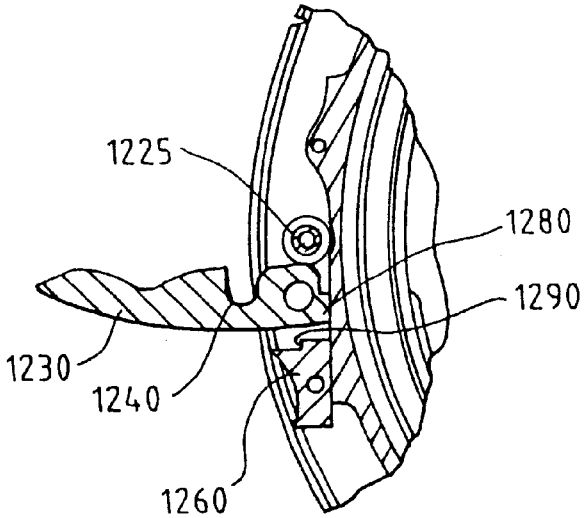
Figure 19C:
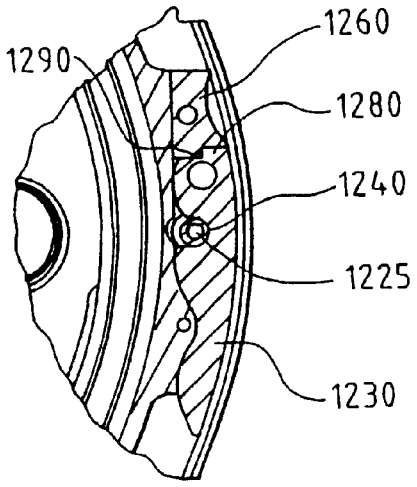
Figure 20A:
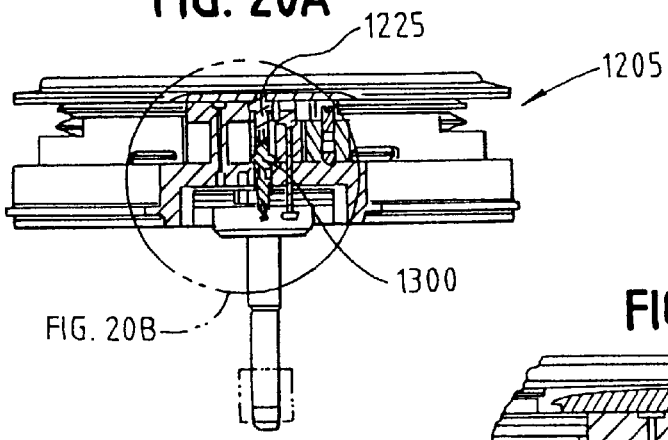
Figure 20B:
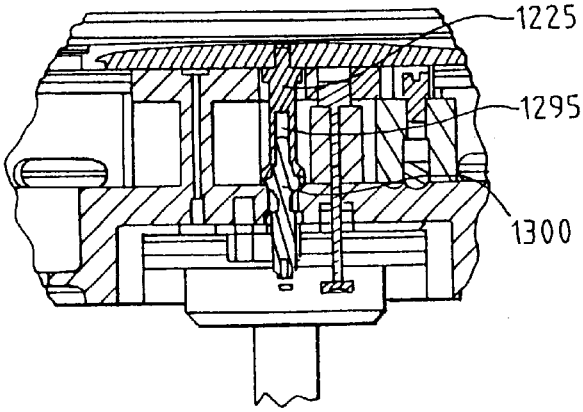
Figure 20C:
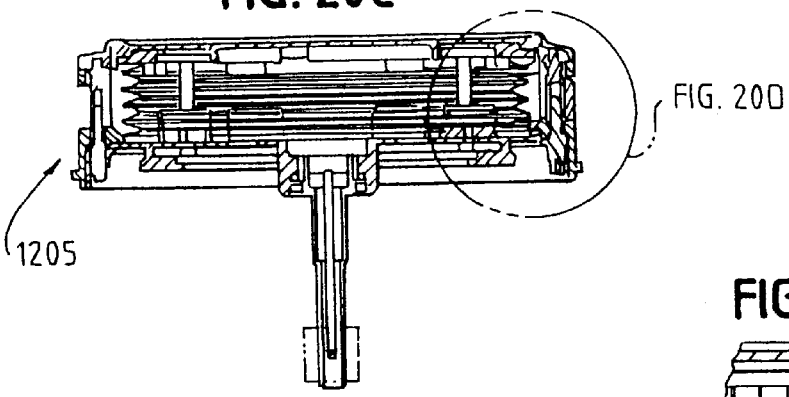
Figure 20D:
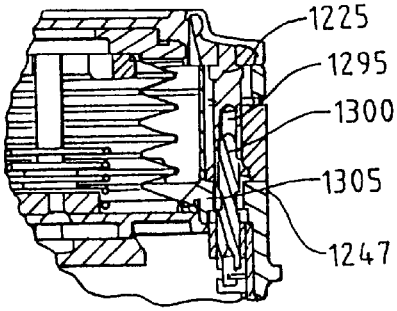

FIGS. 18A and 18B illustrate further details of the latching mechanisms 1215 and the electrically conductive shafts 1225. As illustrated, each latching mechanism 1215 is comprised of a latch body 1250 having aperture 1220, a latch arm 1230 disposed for pivotal movement about a latch arm pivot post 1255, and a safety latch 1260 secured for relatively minor pivotal movement about a safety latch pivot post 1265. The latch body 1250 may also have a purge port 270 disposed therein to conduct a flow of purging fluid to corresponding apertures of the removable contact assembly 210. An O-ring 275 is disposed at the bottom of the flange portions of the conductive shafts 1225 FIGS. 19A–19C are cross-sectional views illustrating operation of the latching mechanisms 1215. As illustrated, latch arm channels 1240 are dimensioned to engage the shaft portions 1245 of the conductive shafts 1225. As the latch arm 1230 is rotated to engage the shaft portions 1245, a nose portion 1280 of the latch arm 1230 cams against the surface 1285 of safety latch 1260 until it mates with channel 1290. With the nose portion 1280 and corresponding channel 1290 in a mating relationship, latch arm 1230 is secured against inadvertent pivotal movement that would otherwise release removable contact assembly 1210 from secure engagement with the rotor base member 1205.

FIGS. 20A–20D are cross-sectional views of the rotor base member 1205 and removable contact assembly 1210 in an engaged state. As can be seen in these cross-sectional views, the electrically conductive shafts 1225 include a centrally disposed bore 1295 that receives a corresponding electrically conductive quick-connect pin 1300. It is through this engagement that an electrically conductive path is established between the rotor base member 1205 and the removable contact assembly 1210.

As also apparent from these cross-sectional views, the lower, interior portion of each latch arm 1230 includes a corresponding channel 1305 that is shaped to engage the flange portions 1247 of the shafts 1225. Edge portions of channel 1305 cam against corresponding surfaces of the flange portions 1247 to drive the shafts 1225 against surface 1310 which, in turn, effects a seal with O-ring 1275.

ROTOR CONTACT DRIVE

Figure 21:
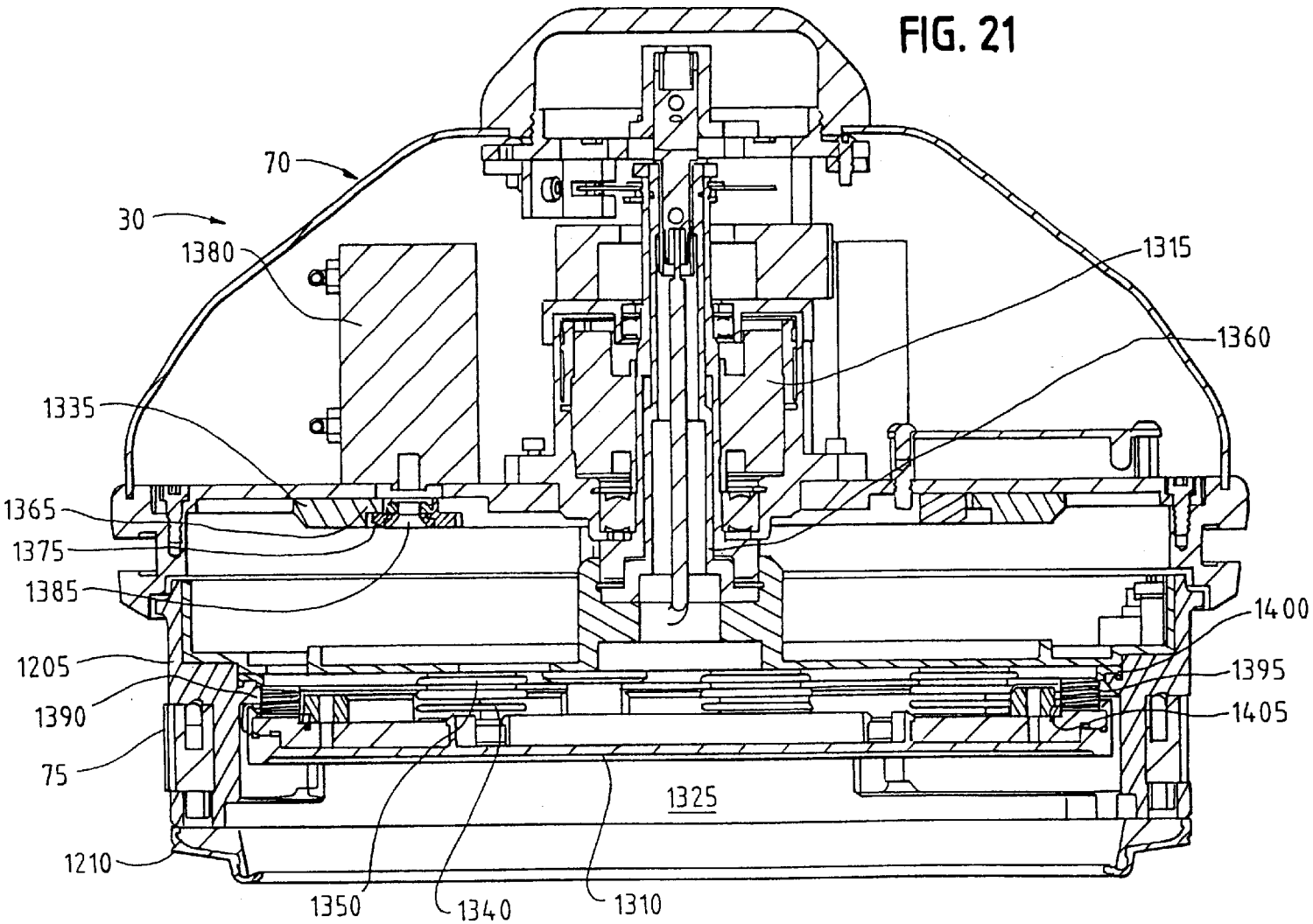
FIG. 21 is a cross-sectional view of the reactor head illustrating the disposition of the reactor head in a condition in which it may accept a workpiece.
Figure 22:
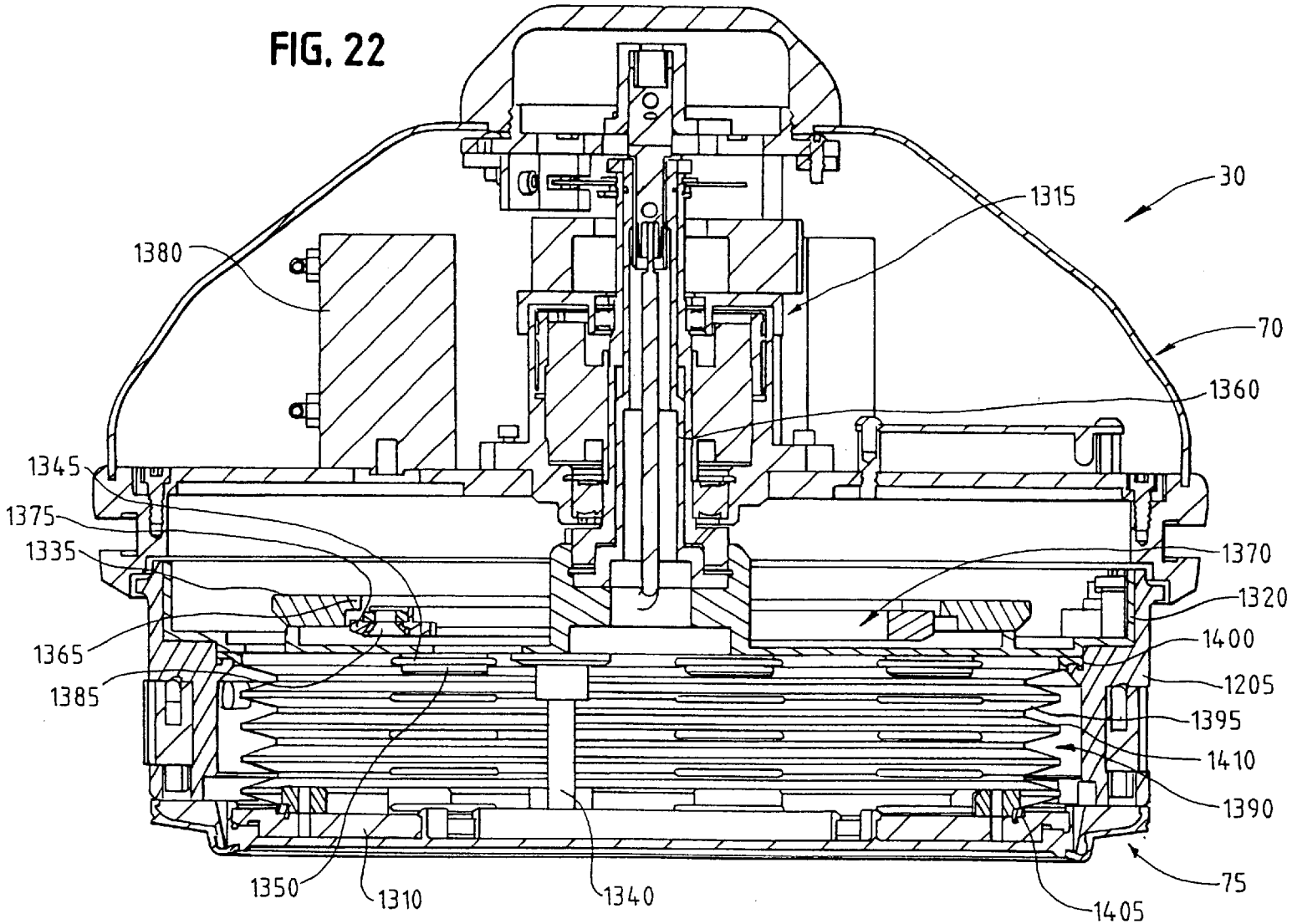
FIG. 22 is a cross-sectional view of the reactor head illustrating the disposition of the reactor head in a condition in which it is ready to present the workpiece to the reactor bowl.
Figure 23:
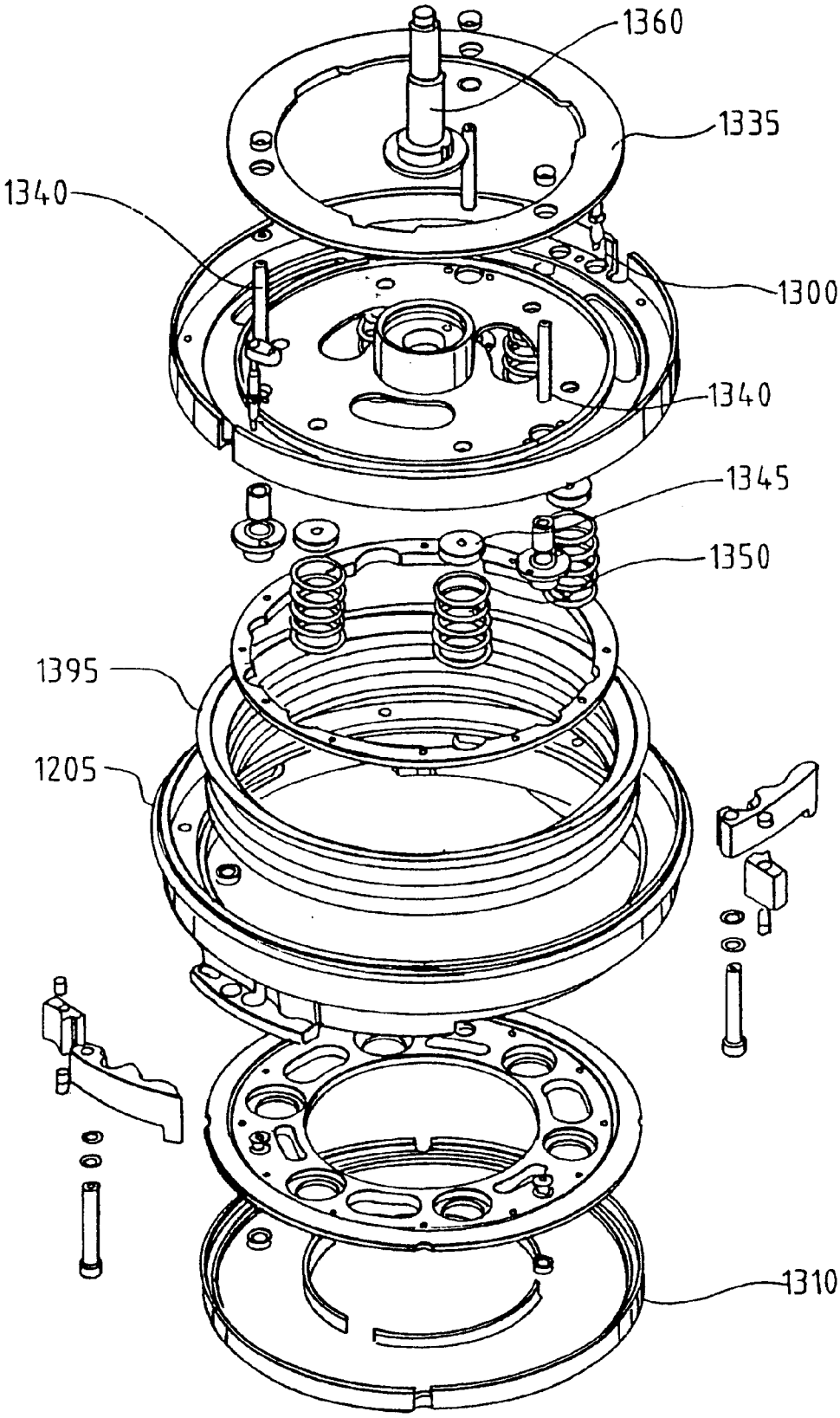
FIG. 23 illustrates an exploded view one embodiment of the rotor assembly.

As illustrated in FIGS. 21, 22 and 23, the rotor assembly 75 includes an actuation arrangement whereby the wafer or other workpiece 25 is received in the rotor assembly by movement in a first direction, and is thereafter urged into electrical contact with the contact assembly by movement of a backing member 310 toward the contact assembly, in a direction perpendicular to the first direction.

As illustrated, the stationary assembly 70 of the reactor head 30 includes a motor assembly 1315 that cooperates with shaft 1320 of rotor assembly 75. Rotor assembly 75 includes a generally annular housing assembly, including rotor base member 1205 and an inner housing 1320. As described above, the contact assembly is secured to rotor base member 1205. By this arrangement, the housing assembly and the contact assembly 1210 together define an opening 1325 through which the workpiece 25 is transversely movable, in a first direction, for positioning the workpiece in the rotor assembly 75. The rotor base member 1205 preferably defines a clearance opening for the robotic arm as well as a plurality of workpiece supports 3130 upon which the workpiece is positioned by the robotic arm after the workpiece is moved transversely into the rotor assembly by movement through opening 1325. The supports 1330 thus support the workpiece 25 between the contact assembly 1210 and the backing member 1310 before the backing member engages the workpiece and urges it against the contact ring.

Reciprocal movement of the backing member 1310 relative to the contact assembly 1210 is effected by at least one spring which biases the backing member toward the contact assembly, and at least one actuator for moving the backing member in opposition to the spring. In the illustrated embodiment, the actuation arrangement includes an actuation ring 1335 which is operatively connected with the backing member 1310, and which is biased by a plurality of springs, and moved in opposition to the springs by a plurality of actuators.

With particular reference to FIG. 21, actuation ring 1335 is operatively connected to the backing member 1310 by a plurality (three) of shafts 1340. The actuation ring, in turn, is biased toward the housing assembly by three compression coil springs 1345 which are each held captive between the actuation ring and a respective retainer cap 350. By this arrangement, the action of the biasing springs 1345 urges the actuation ring 1335 in a direction toward the housing, with the action of the biasing springs thus acting through shafts 1340 to urge the backing member 1335 in a direction toward the contact assembly 1210. The drive shaft 1360 is operatively connected to inner housing 1320 for effecting rotation of workpiece 25, as it is held between contact assembly 210 and backing member 310, during plating processing. The drive shaft 360, in turn, is driven by motor 315 that is disposed in the stationary portion of the reactor head 30.

Rotor assembly 75 is preferably detachable from the stationary portion of the reactor head 30 to facilitate maintenance and the like. Thus, drive shaft 1360 is detachably coupled with the motor 1315. In accordance with the preferred embodiment, the arrangement for actuating the backing member 1310 also includes a detachable coupling, whereby actuation ring 1335 can be coupled and uncoupled from associated actuators which act in opposition to biasing springs 1345.

Actuation ring 1335 includes an inner, interrupted coupling flange 1365. Actuation of the actuation ring 1335 is effected by an actuation coupling 1370 of the stationary assembly 70, which can be selectively coupled and uncoupled from the actuation ring 1335. The actuation coupling 1370 includes a pair of flange portions 1375 which can be interengaged with coupling flange 1365 of the actuation ring 1335 by limited relative rotation therebetween. By this arrangement, the actuation ring 1335 of the rotor assembly 75 can be coupled to, and uncoupled from, the actuation coupling 1370 of the stationary assembly 70 of the reactor head 30.

Actuation coupling 370 is movable in a direction in opposition to the biasing springs 1345 by a plurality of pneumatic actuators 1380 mounted on a frame of the stationary assembly 70. Each actuator 1380 is operatively connected with the actuation coupling 1370 by a respective drive member 1385, each of which extends generally through the frame of the stationary assembly 70.

There is a need to isolate the foregoing mechanical components from other portions of the reactor assembly 20. A failure to do so will result in contamination of the processing environment (here, a wet chemical electroplating environment). Additionally, depending on the particular process implemented in the reactor 20, the foregoing components can be adversely affected by the processing environment.

To effect such isolation, a bellows assembly 1390 is disposed to surround the foregoing components. The bellows assembly 1390 comprises a bellows member 1395, preferably made from Teflon, having a first end thereof secured at 1400 and a second end thereof secured at 1405. Such securement is preferably implemented using the illustrated liquid-tight, tongue-and-groove sealing arrangement. The convolutes 1410 of the bellows member 1395 flex during actuation of the backing plate 1310.

WAFER LOADING/PROCESSING OPERATIONS

Operation of the reactor head 30 will be appreciated from the above description. Loading of workpiece 25 into the rotor assembly 75 is effected with the rotor assembly in a generally upwardly facing orientation, such as illustrated in FIG. 3. Workpiece 25 is moved transversely through the opening 325 defined by the rotor assembly 75 to a position wherein the workpiece is positioned in spaced relationship generally above supports 1330. A robotic arm 415 is then lowered (with clearance opening 325 accommodating such movement), whereby the workpiece is positioned upon the supports 1330. The robotic arm 415 can then be withdrawn from within the rotor assembly 75.

The workpiece 25 is now moved perpendicularly to the first direction in which it was moved into the rotor assembly. Such movement is effected by movement of backing member 1310 generally toward contact assembly 1210. It is presently preferred that pneumatic actuators 1380 act in opposition to biasing springs 1345 which are operatively connected by actuation ring 1335 and shafts 1340 to the backing member 1310. Thus, actuators 1380 are operated to permit springs 1345 to bias and urge actuation ring 1335 and, thus, backing member 1310, toward contact 210. FIG. 12 illustrates the disposition of the reactor head 30 in a condition in which it may accept a workpiece, while FIG. 22 illustrates the disposition of the reactor head and a condition in which it is ready to present though workpiece to the reactor bowl 35.

In the preferred form, the connection between actuation ring 1335 and backing member 1310 by shafts 1340 permits some "float". That is, the actuation ring and backing member are not rigidly joined to each other. This preferred arrangement accommodates the common tendency of the pneumatic actuators 1380 to move at slightly different speeds, thus assuring that the workpiece is urged into substantial uniform contact with the electroplating contacts of the contact assembly 1210 while avoiding excessive stressing of the workpiece, or binding of the actuation mechanism.

With the workpiece 25 firmly held between the backing member 1310 and the contact assembly 1210, lift and rotate apparatus 80 rotates the reactor head 30 and lowers the reactor head into a cooperative relationship with reactor bowl 35 so that the surface of the workpiece is placed in contact with the surface of the plating solution (i.e., the meniscus of the plating solution) within the reactor vessel. FIG. 1 illustrates the apparatus in this condition. If a contact assembly such as contact assembly 85 is used in the reactor 20, the contact assembly 85 seals the entire peripheral region of the workpiece. Depending on the particular electroplating process implemented, it may be useful to insure that any gas which accumulates on the surface of the workpiece is permitted to vent and escape. Accordingly, the surface of the workpiece may be disposed at an acute angle, such as on the order of two degrees from horizontal, with respect to the surface of the solution in the reactor vessel. This facilitates venting of gas from the surface of the workpiece during the plating process as the workpiece, and associated backing and contact members, are rotated during processing. Circulation of plating solution within the reactor bowl 35, as electrical current is passed through the workpiece and the plating solution, effects the desired electroplating of the solder on the surface of the workpiece.

A number of features of the present reactor facilitate efficient and cost-effective electroplating of of solder on workpieces such as semiconductor wafers. By use of a contact assembly having substantially continuous contact in the form of a large number of sealed, compliant discrete contact regions, a high number of plating contacts are provided while minimizing the required number of components. The actuation of the backing member 1310 is desirably effected by a simple linear motion, thus facilitating precise positioning of the workpiece, and uniformity of contact with the contact ring. The isolation of the moving components using a bellows seal arrangement further increases the integrity of the electroplating process.

Maintenance and configuration changes are easily facilitated through the use of a detachable contact assembly 1210. Further, maintenance is also facilitated by the detachable configuration of the rotor assembly 75 from the stationary assembly 70 of the reactor head. The contact assembly provides excellent distribution of electroplating power to the surface of the workpiece, while the preferred provision of the peripheral seal protects the contacts from the plating environment (e.g., contact with the plating solution), thereby desirably preventing build-up of solder onto the electrical contacts. The perimeter seal also desirably prevents plating onto the peripheral portion of the workpiece.

INTEGRATED PLATING TOOL

Figure 24:
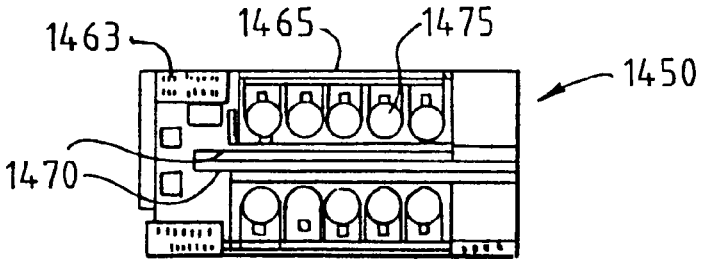
FIGS. 24–26 are top plan views of integrated processing tools that may incorporate electroless plating reactors and electroplating reactors in combination.
Figure 25:
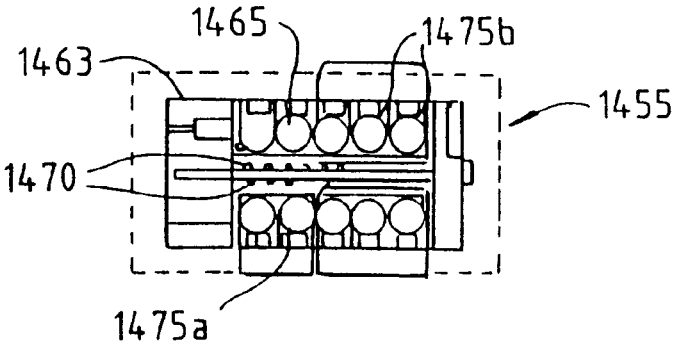
Figure 26:
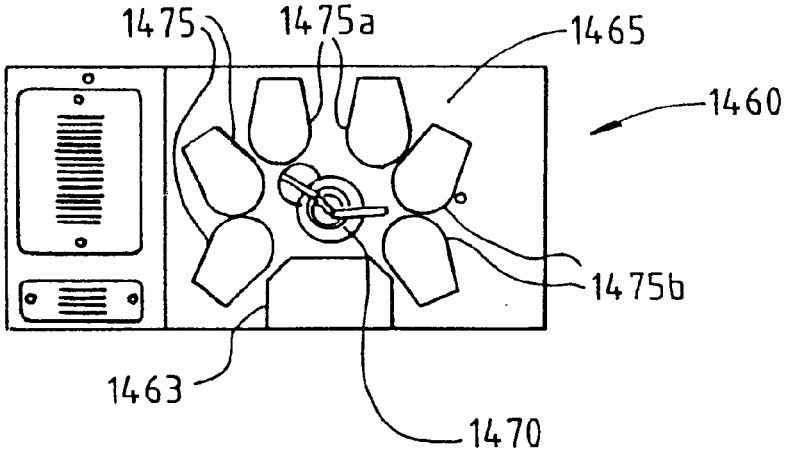

FIGS. 24 through 26 are top plan views of integrated processing tools, shown generally at 1450, 1455, and 1500 that may incorporate electroless plating reactors and electroplating reactors as a combination for plating on a microelectronic workpiece, such as a semiconductor wafer. Processing tools 1450 and 1455 are each based on tool platforms developed by Semitool, Inc., of Kalispell, Mont. The processing tool platform of the tool 450 is sold under the trademark LT-210™, the processing tool platform of the tool 1455 is sold under the trademark LT-210C™, and the processing tool 1500 is sold under the trademark EQUINOX™. The principal difference between the tools 1450, 1455 is in the footprints required for each. The platform on which tool 1455 is based has a smaller footprint than the platform on which tool 1455 is based. Additionally, the platform on which tool 1450 is based is modularized and may be readily expanded. Each of the processing tools 1450, 4155, and 1500 are computer programmable to implement user entered processing recipes.

Each of the processing tools 1145, 1455, and 1500 include an input/output section 1460 a processing section 1465, and one or more robots 1470. The robots 1470 for the tools 1450 1455 move along a linear track. The robot 1470 for the tool 1500 is centrally mounted and rotates to access the input/output section 1460 and the processing section 1465. Each input/output section 1460 is adapted to hold a plurality of workpieces, such as semiconductor wafers, in one or more workpiece cassettes. Processing section 1465 includes a plurality of processing stations 1475 that are used to perform one or more fabrication processes on the semiconductor wafers. The robots 1470 are used to transfer individual wafers from the workpiece cassettes at the input/output section 1460 to the processing stations 1475, as well as between the processing stations 1475.

One or more of the processing stations 1475 are configured as electroplating assemblies, such as the electroplating assembly described above, for electroplating solder onto the semiconductor wafers. For example, each of the processing tools 1450 and 1455 may include eight solder plating reactors and a single pre-wet/rinse station. The pre-wet/rinse station is preferably one of the type available from Semitool, Inc. Alternatively, each of the processing tools 1450 and 1455 may be configured to plate copper studs onto the semiconductor wafers and plate solder, such as eutectic solder, over the copper studs. In such instances, for example, five of the processing stations 1475 may be configured to plate eutectic solder, one of the stations may be configured to plate the copper studs, one of the stations may be configured to execute a pre-wet/rinse process, and one of the stations may be configured as a spin rinser/dryer (SRD). Still further, each of the processing tools 1450 and 1455 may be configured to plate two different types of solder (e.g., eutectic solder and high lead solder). It will now be recognized that a wide variation of processing station configurations may be used in each of the individual processing tools 1450, 1455 and 1500 to execute pre-solder electroplating and post-solder electroplating processes. As such, the foregoing configurations are merely illustrative of the variations that may be used.

Numerous modifications may be made to the foregoing system without departing from the basic teachings thereof. Although the present invention has been described in substantial detail with reference to one or more specific embodiments, those of skill in the art will recognize that changes may be made thereto without departing from the scope and spirit of the invention as set forth in the appended claims.

What is claimed is:

1. An apparatus for plating solder on a microelectronic workpiece comprising:

a reactor chamber adapted to hold an electroplating solution comprising an aqueous solution including a lead compound as a source of lead ions and a tin compound as a source of tin ions;

a chemical delivery system adapted to provide the electroplating solution comprising the aqueous solution including the lead compound and the tin compound to the reactor chamber at a high flow rate;

a workpiece support including a contact assembly for providing electroplating power to a surface at a side of the workpiece that is to be plated, the contact arranged for contacting the workpiece at a large plurality of discrete contact points, the contact points being isolated from exposure to the electroplating solution;

a consumable anode comprised of a metal selected from the group consisting of tin and lead, the consumable anode being spaced from the workpiece support within the reaction chamber and positioned for contact with the electroplating solution.

2. An apparatus as claimed in claim 1 wherein the chemical delivery system is adapted to supply an electroplating solution that further comprises methane sulfonic acid.

3. An apparatus as claimed in claim 1 at wherein the consumable anode is comprised of lead.

4. An apparatus as claimed in claim 1 wherein the consumable anode is comprised of tin.

5. Apparatus as claimed in claim reference claim 1 wherein the contact assembly comprises:

a plurality of contacts disposed to contact a peripheral edge of the surface of the workpiece, the plurality of contacts executing a wiping action against the surface of the workpiece as the workpiece is brought into engagement therewith, and a barrier disposed interior of the plurality of contacts and including a member disposed to engage the surface of the workpiece to effectively isolate the plurality of contacts from the electroplating solution.

6. A reactor as claimed in claim 5 wherein the plurality of contacts are in the form of discrete flexures.

7. A reactor as claimed in claim 5 wherein the plurality of contacts are in the form a Belleville ring contact.

8. A reactor as claimed in claim 5 and further comprising a flow path disposed in the contact assembly, the flow path being adapted to provide a purging gas to the plurality of contacts and the peripheral edge of the workpiece.

9. A reactor as claimed in claim 8 wherein the flow path is connected to a source of purging gas to thereby assist in isolating the plurality of contacts from the electroplating solution.

10. An apparatus for plating solder on a microelectronic workpiece comprising:

a moveable head including a rotor and rotor drive adapted to rotate the workpiece during processing thereof;

a processing base adapted to hold an aqueous electroplating solution including a concentration of lead ions and a concentration of tin ions;

a chemical delivery system connected to deliver the aqueous electroplating solution including a concentration of lead ions and a concentration of tin ions to the processing base at a high flow rate;

a contact assembly disposed on the rotor of the moveable head, the contact assembly providing electroplating power to a peripheral edge surface of a side of the workpiece that is to be plated, the contact assembly contacting the workpiece at a large plurality of discrete contact points, the contact points being sealed from exposure to the electroplating solution;

an actuator disposed to move the moveable head between a loading position in which the workpiece may be placed for support on the rotor and into engagement with the contact, and a processing position in which the surface of the workpiece that is to be electroplated is brought into contact with the electroplating solution with the side of the wafer that is to be processed in a face down orientation during electroplating;

a consumable anode disposed in the processing base and positioned for contact with the electroplating solution, the consumable anode comprising a metal selected from the group consisting of lead and tin.

11. An apparatus as claimed in claim 10 wherein the chemical delivery system is adapted to provide an electroplating solution that further comprises methane sulfonic acid.

12. An apparatus as claimed in claim 10 wherein the anode is comprised of lead.

13. An apparatus as claimed in claim 10 wherein the anode is comprised of tin.

14. Apparatus as claimed in claim reference claim 10 wherein the contact assembly comprises:

a plurality of contacts disposed to contact a peripheral edge of the surface of the workpiece, the plurality of contacts executing a wiping action against the surface of the workpiece as the workpiece is brought into engagement therewith, and a barrier disposed interior of the plurality of contacts and including a member disposed to engage the surface of the workpiece to effectively isolate the plurality of contacts from the electroplating solution.

15. A reactor as claimed in claim 14 wherein the plurality of contacts are in the form of discrete flexures.

16. A reactor as claimed in claim 14 wherein the plurality of contacts are in the form of a Belleville ring contact.

17. A reactor as claimed in claim 14 and further comprising a flow path disposed in the contact assembly, said flow path being adapted to conduct a flow of a purging gas to the plurality of contacts and the peripheral edge of the workpiece.

18. A reactor as claimed in claim 17 wherein the flow path is connected to a source of purging gas to thereby assist in isolating the plurality of contacts from the electroplating solution.

* * * * *